US011167573B2

(12) United States Patent
Kawajiri

(10) Patent No.: US 11,167,573 B2
(45) Date of Patent: Nov. 9, 2021

(54) ROLL MEDIUM FEEDING SHAFT

(71) Applicant: SEIKO EPSON CORPORATION, Tokyo (JP)

(72) Inventor: Masahiro Kawajiri, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 235 days.

(21) Appl. No.: 16/360,798

(22) Filed: Mar. 21, 2019

(65) Prior Publication Data

US 2019/0291483 A1 Sep. 26, 2019

(30) Foreign Application Priority Data

Mar. 22, 2018 (JP) ..... JP2018-054051

(51) Int. Cl.
*B41J 15/04* (2006.01)
*B65H 16/04* (2006.01)

(52) U.S. Cl.
CPC ..... *B41J 15/048* (2013.01); *B65H 16/04* (2013.01)

(58) Field of Classification Search
CPC ..... B41J 15/042; B41J 15/048; B65H 16/04; B65H 16/06
See application file for complete search history.

(56) References Cited

U.S. PATENT DOCUMENTS

2005/0258301 A1* 11/2005 Hirte ..... B65H 75/242 242/597.6
2011/0229241 A1* 9/2011 Takahashi ..... B65H 75/241 400/611
2014/0186086 A1 7/2014 Yato

FOREIGN PATENT DOCUMENTS

JP 2014-125330 A 7/2014

* cited by examiner

*Primary Examiner* — Sang K Kim
(74) *Attorney, Agent, or Firm* — Chip Law Group

(57) ABSTRACT

According to an aspect of the invention, a roll medium feeding shaft to be inserted into a through hole of a roll medium formed by winding a long recording medium is provided. The roll medium feeding shaft includes a holding member configured to be inserted into the through hole and to be rotated about a rotary axis together with the roll medium, a support part provided to one end of the roll medium feeding shaft and configured to support the holding member in a vertical direction when placed on a horizontal surface, and a shaft provided inside the holding member.

4 Claims, 13 Drawing Sheets

ROLL MEDIUM FEEDING SHAFT

BACKGROUND

1. Technical Field

The invention relates to a roll medium feeding shaft.

2. Related Art

Such a feeding shaft is known that is to be inserted into a roll medium formed by winding a recording medium in a roll (e.g., JP-A-2014-125330).

The feeding shaft includes, at both end parts in a shaft direction, protruded parts protruding in the shaft direction and used to secure the feeding shaft to a printing apparatus. Since the protruded parts each have a narrower width, a user exchanging the roll medium in the printing apparatus cannot place one of the end parts of the feeding shaft on a work bench in order to allow the feeding shaft to stand vertically. Therefore, the user has to hold a roll medium by one hand, and, by the other hand, to insert the feeding shaft into the roll medium to exchange the roll medium. When a roll medium is too heavy, and a user cannot hold the roll medium by one hand, the user has to place the roll medium on a work bench in order to insert the feeding shaft for exchanging, for example. When the roll medium comes into contact with the work bench, the roll medium may become dirty or may be damaged. The feeding shaft described above is not convenient for a user exchanging a roll medium. Such an issue is commonly observed in not only feeding shafts for printing apparatuses, but also feeding shafts for roll media used in various apparatuses.

SUMMARY

According to an aspect of the invention, a roll medium feeding shaft to be inserted into a through hole of a roll medium formed by winding a long recording medium is provided. The roll medium feeding shaft includes a holding member configured to be inserted into the through hole and to be rotated about a rotary axis together with the roll medium, a support part provided to one end of the roll medium feeding shaft and configured to support the holding member in a vertical direction when placed on a horizontal surface, and a shaft provided inside the holding member and configured to be movable inside the holding member along the rotary axis. The shaft is to be one of a first state where the one end of the shaft does not protrude from the support part and a second state where the one end of the shaft protrudes from the support part. When the one end of the shaft is oriented downward in the vertical direction and the support part is placed on the horizontal surface, the shaft is in the first state.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Exemplary Embodiment

Figure 1:
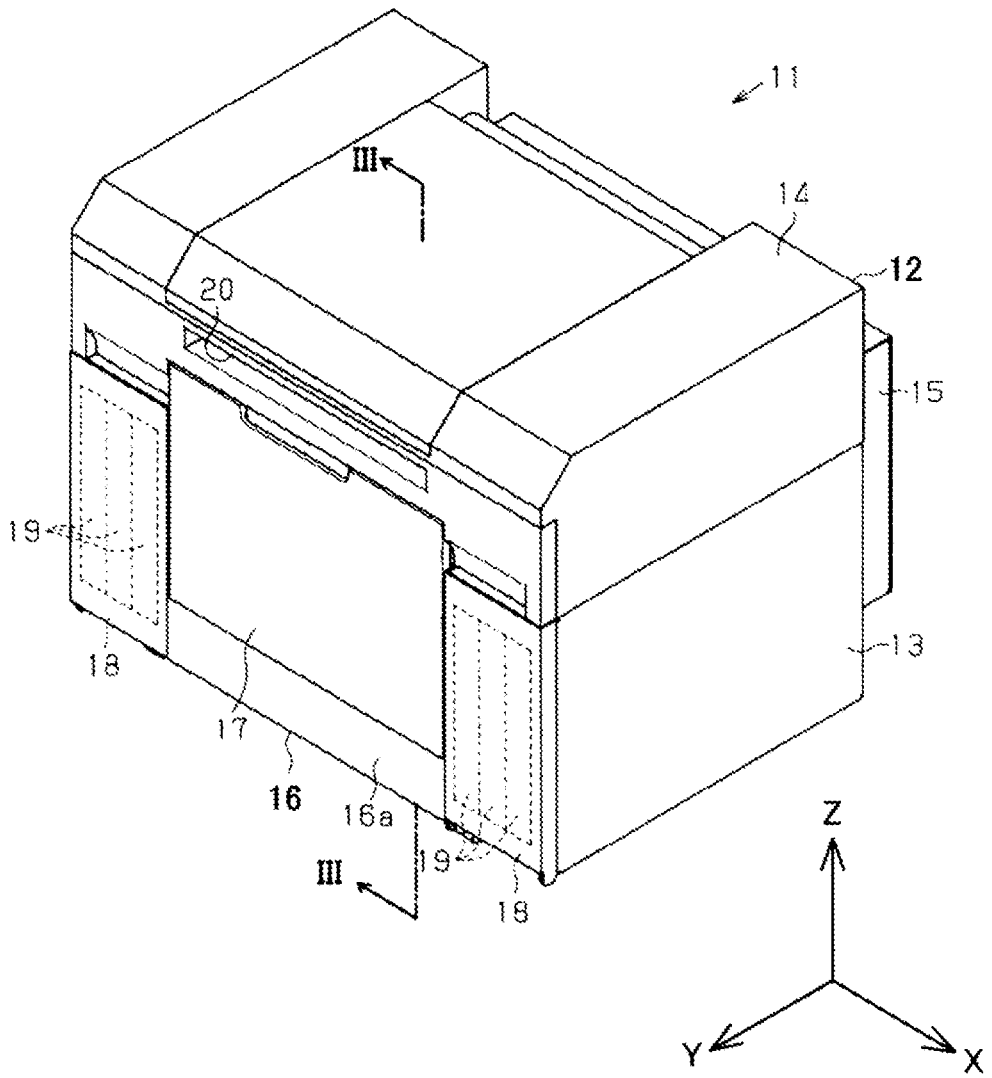
FIG. 1 is a perspective view illustrating an exterior of a printing apparatus according to an exemplary embodiment.

FIG. 1 is a perspective view illustrating an exterior of a printing apparatus 11 according to the exemplary embodiment. FIG. 1 illustrates arrows representing X, Y, and Z directions orthogonal to each other. The X direction and the Y direction are directions parallel to a horizontal surface, whereas the Z direction is a direction opposite to a gravitational direction (vertical direction). The arrows representing the X, Y, and Z directions are also provided in other drawings as required to correspond to FIG. 1.

The printing apparatus 11 according to the exemplary embodiment includes a housing 12 having a substantially rectangular box shape. The housing 12 includes a first accommodation part 13, a second accommodation part 14 arranged above the first accommodation part 13 in the vertical direction (Z direction), and a third accommodation part 15 arranged behind the first accommodation part 13 (opposite direction to the Y direction).

The first accommodation part 13 includes a holding frame 16 configured to internally accommodate recording media. A front of the first accommodation part 13 is provided with a front end surface 16*a* of the holding frame 16, a front cover 17 detachably attached above the front end surface 16*a*, and open and close covers 18 provided on both sides in the X direction of the holding frame 16.

The open and close covers 18 are covers for ink cartridges 19. Upper ends of the open and close covers 18 respectively open about rotary shafts (not illustrated) provided on lower ends (opposite direction to the Z direction). The open and close covers 18 are attached to be openable between a closed position illustrated in FIG. 1 and an open position at which respective upper end parts open forward to cause respective insides to be exposed. When the open and close covers 18 are each arranged to the open position, cartridge holders (not illustrated) configured to be detachably attached with the ink cartridges 19 configured to accommodate liquids (e.g., inks) are exposed.

An outlet port 20 for allowing recording media having undergone recording to exit is provided to the second accommodation part 14 in the Y direction (on a front). Recording media pass from the first accommodation part 13 through the second accommodation part 14, and exit from the outlet port 20.

Figure 2:
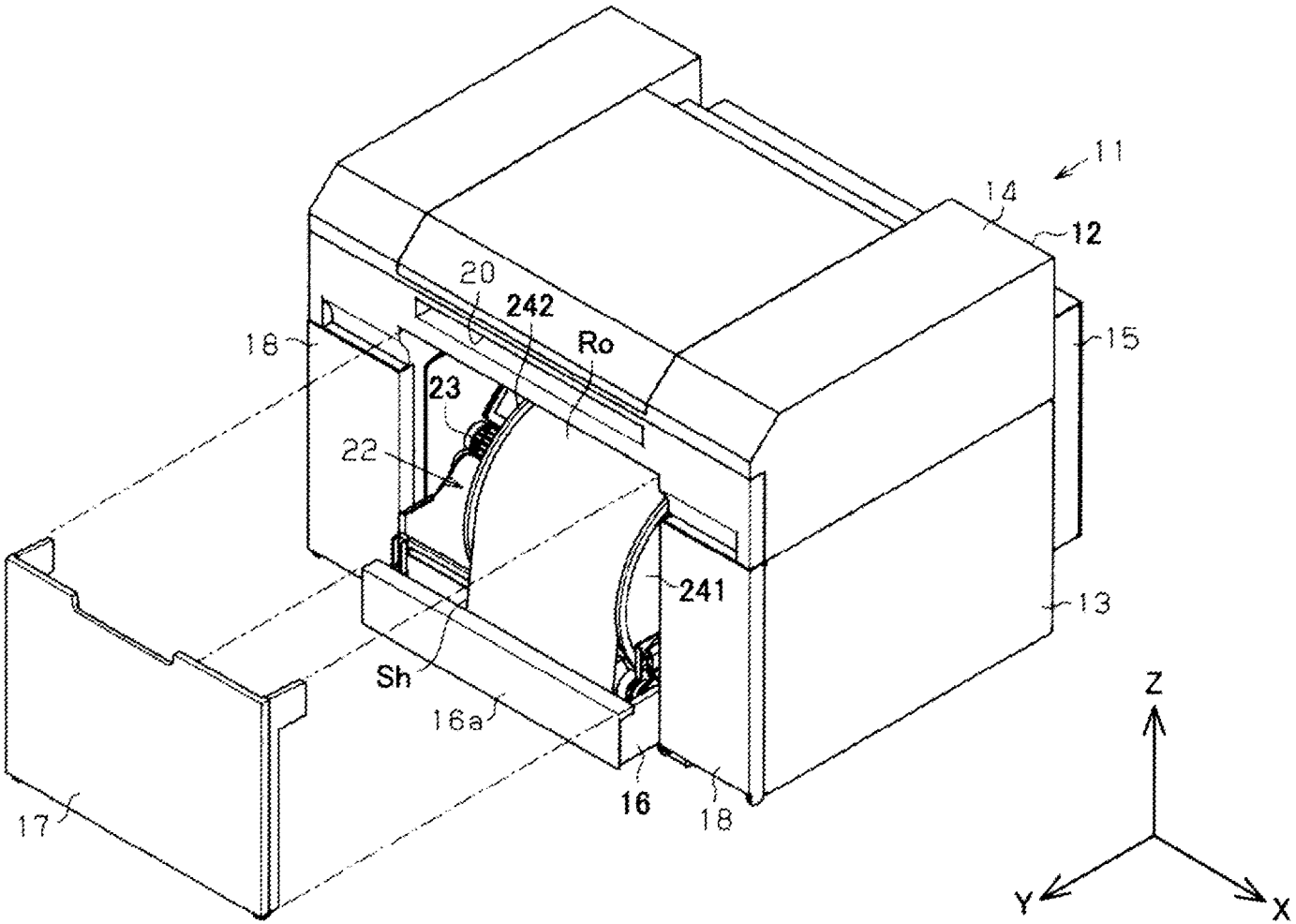
FIG. 2 is a perspective view schematically illustrating the exterior of the printing apparatus when a front cover is removed.

FIG. 2 is a perspective view schematically illustrating the exterior of the printing apparatus 11 when the front cover 17 is removed. The holding frame 16 is provided with side walls 22. The side walls 22 are configured to rotatably support a roll medium Ro formed by winding a long recording medium Sh. The side walls 22 are exchangeably mounted with the roll medium Ro having one of a plurality of sizes. The holding frame 16 of the first accommodation part 13 can move between an exchange position at which the roll medium Ro of the recording medium Sh is exchangeable, and a feed position at which the recording medium Sh can be fed from the roll medium Ro to a recording unit 54 described later. To set the roll medium Ro to the side walls 22, the front cover 17 is first removed from the housing 12. The holding frame 16 is then pulled out to a position in front of the housing 12 in the Y direction, i.e., the exchange position.

Figure 3:
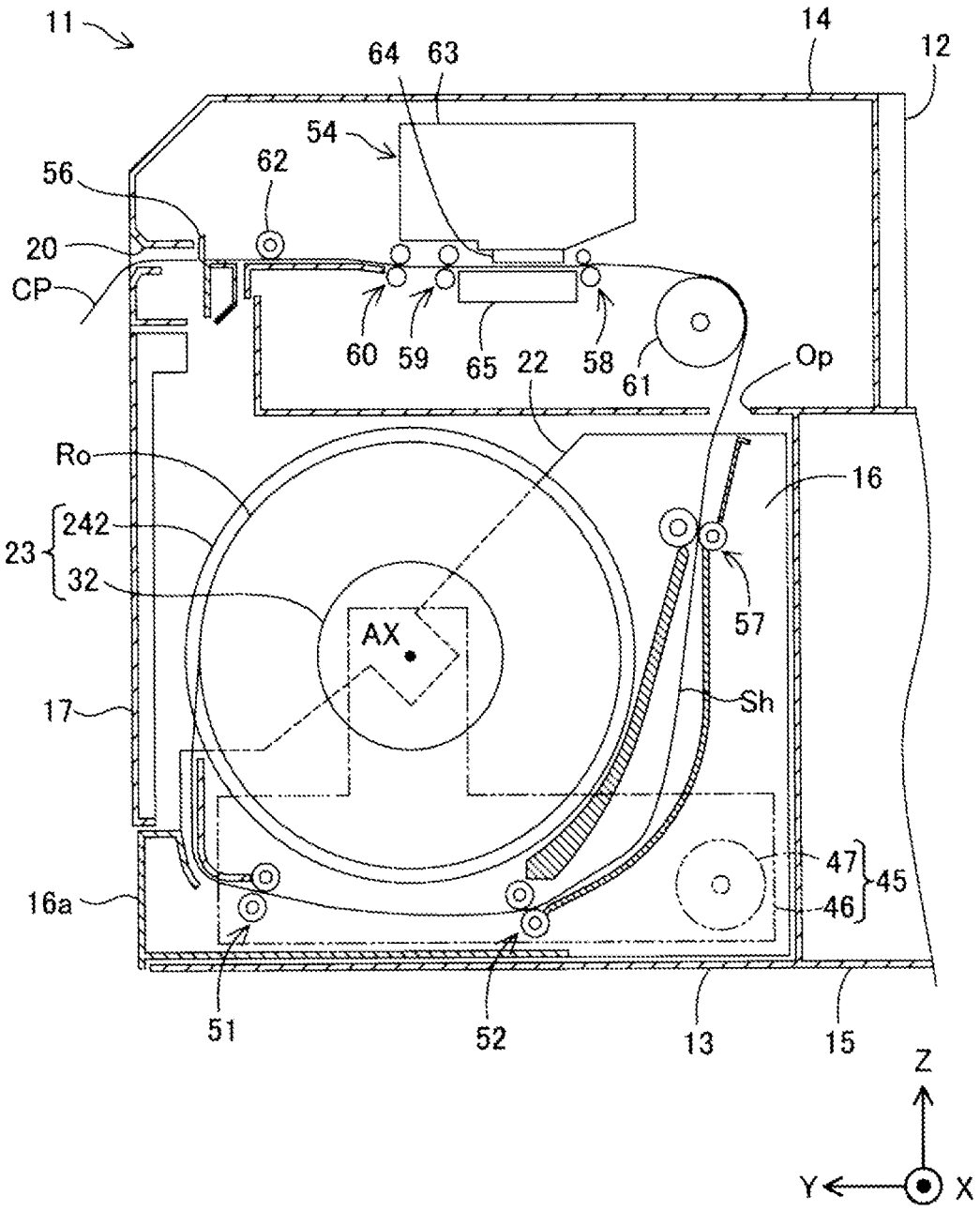
FIG. 3 is a cross-sectional view taken along a position of line III-III in FIG. 1.

FIG. 3 is a cross-sectional view taken along a position of line III-III in FIG. 1. FIG. 3 illustrates an internal structure of the first accommodation part 13 and the second accommodation part 14 of the printing apparatus 11. The first accommodation part 13 includes the holding frame 16. The holding frame 16 of the first accommodation part 13 includes a feeding mechanism 45 and feeding roller pairs 51, 52, and 57. An opening Op is provided above the feeding roller pair 57 in the gravitational direction, i.e., on a wall surface in the Z direction of the first accommodation part 13. The opening Op forms a slit joining a feeding path for the recording medium Sh from the first accommodation part 13 to the second accommodation part 14.

Note that, in the specification, a direction of feeding the recording medium Sh, in which the recording medium Sh fed from the roll medium Ro heads from the first accommodation part 13, via the second accommodation part 14, to the outlet port 20, is also simply referred to as a "feeding direction". Rotation of the rollers to feed the recording medium Sh in the feeding direction is also referred to as "normal rotation".

The printing apparatus 11 according to the exemplary embodiment is configured to execute a control of causing a controller (not illustrated) to allow the rollers to normally rotate, to feed the recording medium Sh on the feeding path in a direction toward the recording unit 54, and to control a position of the recording medium Sh to be undergone recording by the recording unit 54. Upon reception of an instruction for exchanging the roll medium Ro, for example, the controller (not illustrated) executes a control of causing the rollers to reverse-rotate to feed the recording medium Sh in a direction of winding the recording medium Sh onto the roll medium Ro. The "rollers" include a roll medium feeding shaft 23 and the feeding roller pairs 51, 52, and 57 in the first accommodation part 13, as well as include a converting roller 61, feeding roller pairs 58, 59, and 60, and an outlet roller 62 in the second accommodation part 14.

The feeding mechanism 45 is configured to transmit power of normally rotating the rollers in the first accommodation part 13 to cause the rollers to feed the recording medium Sh. The feeding mechanism 45 includes a motor 47 and a power transmission mechanism 46. The power transmission mechanism 46 includes a plurality of toothed gears, and is configured to transmit power of the motor 47 to the rollers in the first accommodation part 13. Upon reception of the driving power of the motor 47 via the power transmission mechanism 46, the roll medium feeding shaft 23 arranged to the side walls 22 rotates about a rotary axis AX. As rotation of the roll medium feeding shaft 23 is transmitted to a first flange 241 described later secured to the roll medium feeding shaft 23, the roll medium Ro rotates.

The second accommodation part 14 includes the converting roller 61, the feeding roller pairs 58, 59, and 60 that are pairs of rollers, the outlet roller 62, the recording unit 54, a cutter 56, and the outlet port 20.

In the exemplary embodiment, the converting roller 61 is provided outside the first accommodation part 13, inside the second accommodation part 14, and above the opening Op in the Z direction. In the feeding path for the recording medium Sh from the roll medium Ro to the recording unit 54, the converting roller 61 converts the direction of feeding the recording medium Sh into a horizontal direction.

As the recording medium Sh is fed from the first accommodation part 13, via the opening Op, to the second accommodation part 14, the converting roller 61 converts the feeding direction into the horizontal direction (in the exemplary embodiment, the Y direction). Upon the conversion of the feeding direction into the horizontal direction, the feeding roller pairs 58, 59, and 60 and the outlet roller 62 normally rotate to feed the recording medium Sh via the recording unit 54 toward the outlet port 20.

The recording unit 54 is a liquid discharging apparatus configured to accept an instruction given by the controller (not illustrated), to discharge liquids (inks), and to perform recording (printing) onto the recording medium Sh. The recording unit 54 includes a carriage 63 configured to move back and forth in the X direction, and a liquid discharging unit 64 arranged below the carriage 63 in the gravitational direction (opposite direction to the Z direction). Below the liquid discharging unit 64 in the gravitational direction, and at a position facing the liquid discharging unit 64, a support member 65 configured to support the recording medium Sh is arranged.

After the recording unit 54 performs recording, the cutter 56 cuts the recording medium Sh per unit length to form a single cut-sheet CP (see left top in FIG. 3). The single cut-sheet CP having undergone recording exits the housing 12 from the outlet port 20.

Figure 4:
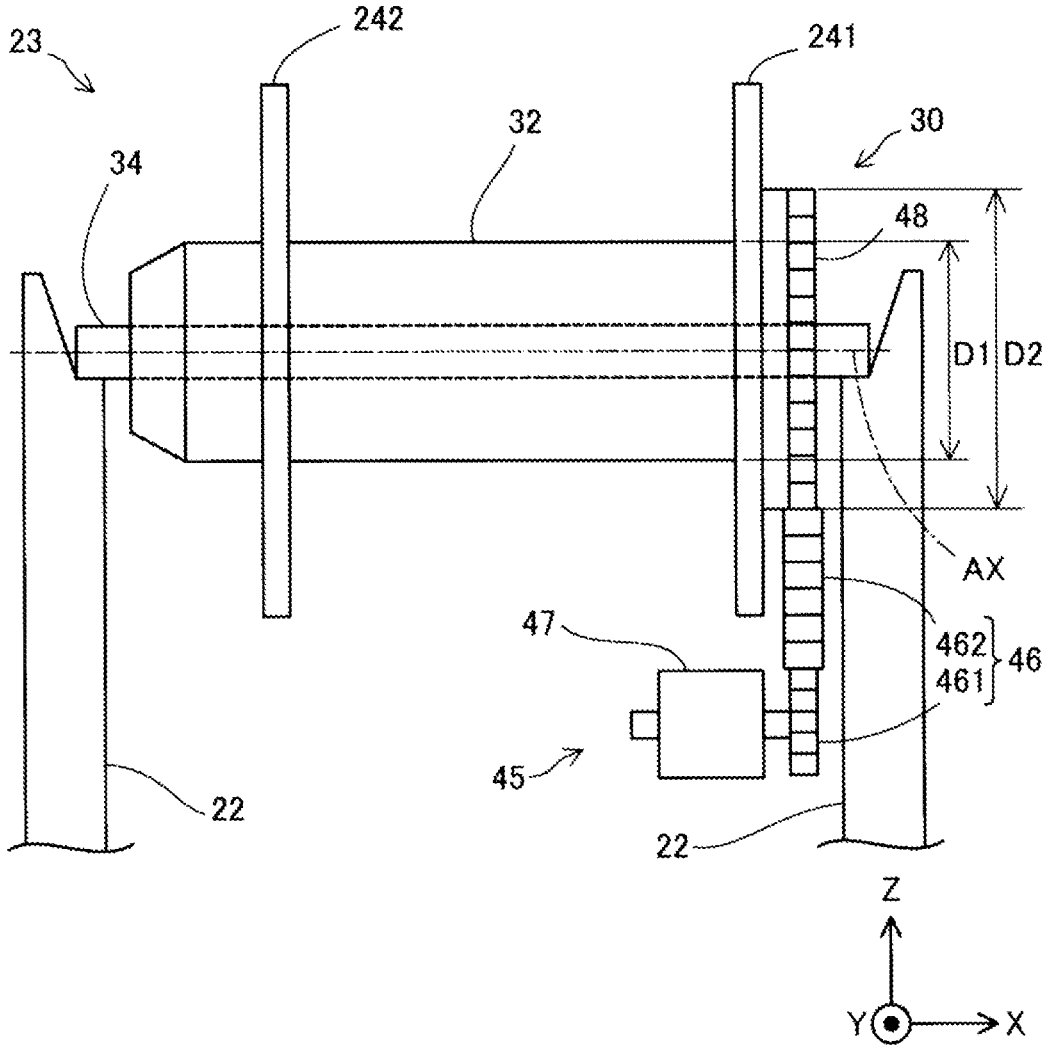
FIG. 4 is a side view schematically illustrating a roll medium feeding shaft supported by side walls.

FIG. 4 is a side view schematically illustrating the roll medium feeding shaft 23 supported by the side walls 22. For ease of understanding of the technique, FIG. 4 does not illustrate the roll medium Ro. FIG. 4 illustrates the rotary axis AX of the roll medium feeding shaft 23, in addition to other members.

The roll medium feeding shaft 23 is a member configured to support the roll medium Ro, to rotate, and to feed the recording medium Sh of the roll medium Ro in the feeding direction. The roll medium feeding shaft 23 includes the first flange 241, a second flange 242, a holding member 32, a shaft 34, a rotation transmission part 48, and a support part 30. Note that the first flange 241, the second flange 242, the shaft 34, the holding member 32, and the rotation transmission part 48 rotate about the rotary axis AX.

The holding member 32 is a substantially cylindrical member to be inserted into a through hole of the roll medium Ro. The holding member 32 rotates about the rotary axis AX together with the roll medium Ro.

The first flange 241 and the second flange 242 are substantially circular plate members, and constitute a pair of flanges configured to rotate integrally with the holding member 32. The first flange 241 and the second flange 242 are provided to allow respective surfaces to orient in a direction perpendicular to the rotary axis AX. As for the first flange 241 and the second flange 242, the second flange 242 provided opposite to the first flange 241 in the X direction is movable in a direction parallel to the rotary axis AX of the roll medium feeding shaft 23 (in the exemplary embodiment, the X direction). The first flange 241 is secured to an end part in the X direction of the holding member 32, and is immovable in the direction parallel to the rotary axis AX of the roll medium feeding shaft 23. The first flange 241 and the holding member 32 may be integrally formed with each other.

After the second flange 242 is removed, the roll medium Ro is inserted into the roll medium feeding shaft 23. The holding member 32 of the roll medium feeding shaft 23 is inserted into the through hole of the roll medium Ro. After the holding member 32 is inserted into the roll medium Ro, the second flange 242 is again attached to the holding member 32 and is moved along the rotary axis AX. Therefore, both ends of the roll medium Ro are pressed by the first flange 241 and the second flange 242. As the roll medium Ro is pressed, the roll medium Ro is held between the first flange 241 and the second flange 242.

The shaft 34 is provided inside the holding member 32. The shaft 34 is provided to be movable along the rotary axis AX inside the holding member 32. As both ends of the shaft 34 are arranged on concaves of the side walls 22, the roll medium feeding shaft 23 is set onto the side walls 22 (see FIG. 3).

The rotation transmission part 48 is a substantially circular toothed gear. An outer circumference part of the rotation transmission part 48 and the power transmission mechanism 46 of the feeding mechanism 45 are coupled with each other. In the exemplary embodiment, the rotation transmission part 48 is provided to the end part (in the X direction), which is provided with the first flange 241, of the holding member 32. A surface of the rotation transmission part 48 is coupled to one of the surfaces (surface in the X direction in FIG. 4) of the first flange 241. The one of the surfaces does not face the second flange 242. The rotation transmission part 48 and the first flange 241 may be integrally formed with each other.

As the motor 47 rotates, a toothed gear 461 transmits a rotational force, via a toothed gear 462, to the rotation transmission part 48. Upon application of the rotational force (external force) on an outer circumference, the rotation transmission part 48 transmits rotation, via the first flange 241, to the holding member 32. With the rotation, the roll medium Ro rotates, and the recording medium Sh is fed in the feeding direction.

When the roll medium feeding shaft 23 is placed on a horizontal surface to allow the shaft 34 of the roll medium feeding shaft 23 to be perpendicular to the horizontal surface, the support part 30 supports the holding member 32 in the vertical direction. The support part 30 is a part of the roll medium feeding shaft 23, and is provided to an end of the roll medium feeding shaft 23. In the specification, the end of the roll medium feeding shaft 23 is regarded as a lower end of the roll medium feeding shaft 23 when the roll medium feeding shaft 23 is placed on a horizontal surface to allow the shaft 34 of the roll medium feeding shaft 23 to be perpendicular to the horizontal surface. In the exemplary embodiment, the support part 30 is a surface of the rotation transmission part 48. The surface is opposite to the surface coupled to the first flange 241.

FIG. 4 illustrates a maximum value D1 of a width of the holding member 32 and a minimum value D2 of a width of the rotation transmission part 48, in addition to other members. The maximum value D1 of the width of the holding member 32 represents a maximum value of the width of the holding member 32 in the direction perpendicular to the rotary axis AX of the holding member 32. More specifically, the maximum value D1 of the width of the holding member 32 represents a diameter of a circle having a maximum diameter among circles externally abutting an external shape of the holding member 32 in the direction perpendicular to the rotary axis AX.

The minimum value D2 of the width of the rotation transmission part 48 represents a minimum value of the width of the rotation transmission part 48 in the direction perpendicular to the rotary axis AX of the rotation transmission part 48. More specifically, the minimum value D2 of the width of the rotation transmission part 48 represents a diameter of a circle having a minimum diameter among circles internally abutting an external shape of the rotation transmission part 48 in the direction perpendicular to the rotary axis AX.

In the roll medium feeding shaft 23 according to the exemplary embodiment, the minimum value D2 of the width of the rotation transmission part 48 in the direction perpendicular to the rotary axis AX is set to be equal to or above the maximum value D1 of the width of the holding member 32 in the direction perpendicular to the rotary axis AX. Therefore, the rotation transmission part 48 having a width equal to or above the width of the holding member 32 serves as the support part 30.

Figure 5:
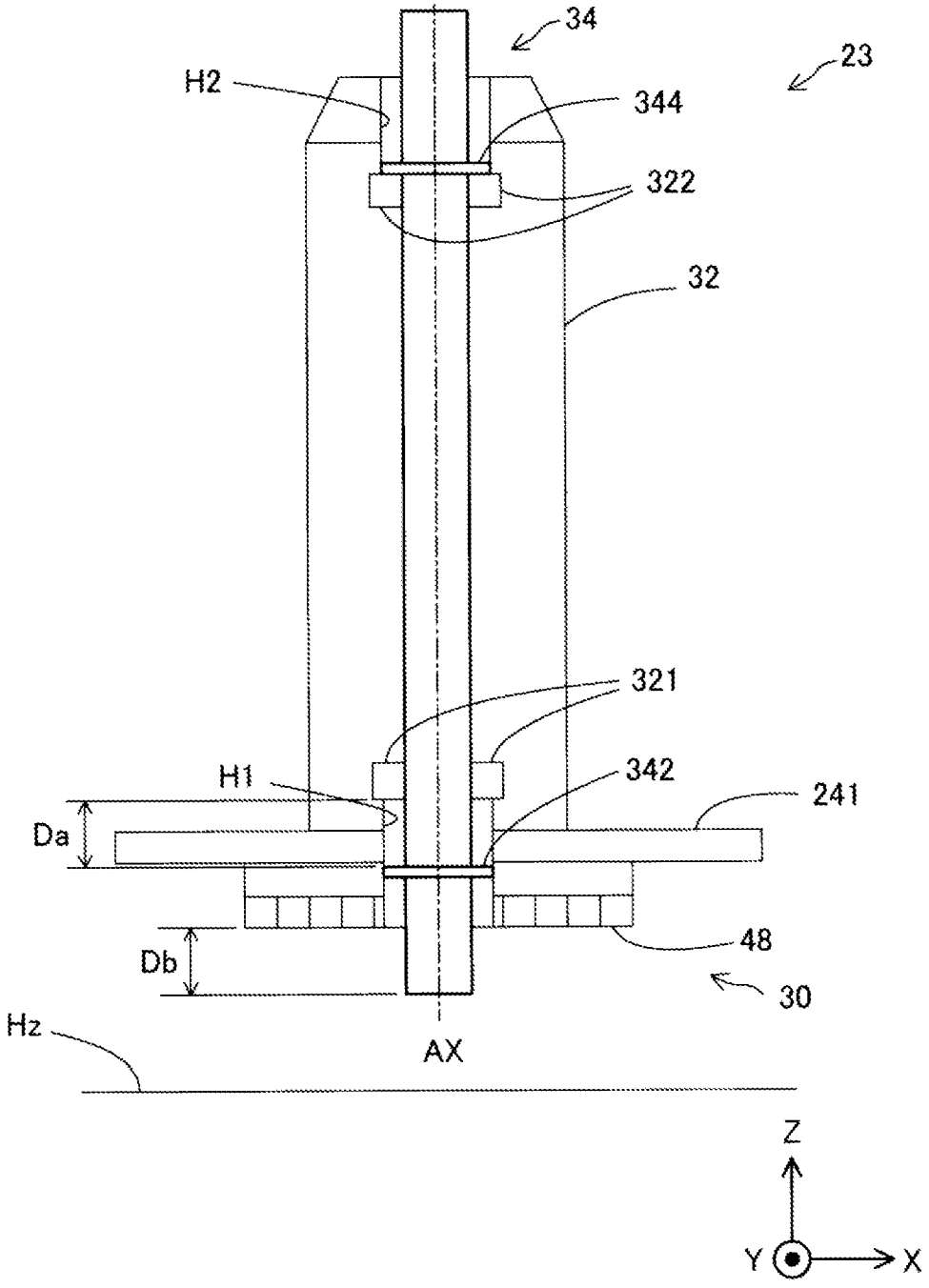
FIG. 5 is a cross-sectional view schematically illustrating an internal structure of the roll medium feeding shaft.

FIG. 5 is a cross-sectional view schematically illustrating an internal structure of the roll medium feeding shaft 23. The cross-sectional view in FIG. 5 illustrates a surface including the rotary axis AX of the roll medium feeding shaft 23. FIG. 5 schematically illustrates a horizontal surface Hz, in addition to other members of the roll medium feeding shaft 23. FIG. 5 illustrates a state where the rotary axis AX of the roll medium feeding shaft 23 is positioned in the vertical direction, and the roll medium feeding shaft 23 is not in contact with the horizontal surface Hz.

The shaft 34 includes, in the exemplary embodiment, a first ring 342 and a second ring 344. Inside the roll medium feeding shaft 23, an opening part H1, an opening part H2, a first bearing 321, and a second bearing 322 are provided. The first ring 342 and the second ring 344 serve as stop rings, and are secured to an outer circumference of the shaft 34.

The opening part H1 is a columnar void provided inside the holding member 32, the first flange 241, and the rotation transmission part 48 on a side, which is provided with the first ring 342, of the roll medium feeding shaft 23. More specifically, the opening part H1 is a void obtained by forming a circle into a columnar shape along the rotary axis AX, in which a diameter of the circle is substantially identical to a diameter of the first ring 342 of the shaft 34. Therefore, the first ring 342 is movable inside the opening part H1 along the rotary axis AX.

The opening part H2 is a columnar void provided inside the holding member 32 on another side, which is provided with the second ring 344, of the roll medium feeding shaft 23. More specifically, the opening part H2 is a void obtained by forming a circle into a columnar shape along the rotary axis AX, in which a diameter of the circle is substantially identical to a diameter of the second ring 344 of the shaft 34. Therefore, the second ring 344 is movable inside the opening part H2 along the rotary axis AX.

The first bearing 321 and the second bearing 322 are provided inside the holding member 32. In the exemplary embodiment, the first bearing 321 and the second bearing 322 may be ball bearings, for example. The first bearing 321 and the second bearing 322 are secured inside the holding member 32 to support the shaft 34 at a position allowing respective rotary axes of the first bearing 321 and the second bearing 322 align with the rotary axis AX. In the exemplary embodiment, the shaft 34 is movable relative to the first bearing 321 and the second bearing 322 along the rotary axis AX. On the other hand, the first bearing 321 and the second bearing 322 are immovable relative to the holding member 32 along the rotary axis AX.

In the exemplary embodiment, the first bearing 321 is provided inside the holding member 32 and positioned closer to a center along the rotary axis AX than the first ring 342. When the holding member 32 is placed on a horizontal surface via the support part 30 in the vertical direction, an end part, which is provided with the first ring 342, of the shaft 34 is pressed against the horizontal surface. The first ring 342 secured to the shaft 34 accordingly moves together with the shaft 34 inside the opening part H1 upward in the vertical direction. As a result, the first ring 342 comes into contact with a side wall of the first bearing 321. As described above, the first bearing 321 serves a function of restricting the shaft 34 from moving toward the center inside the holding member 32.

The second bearing 322 is provided inside the holding member 32 and positioned closer to the center along the rotary axis AX than the second ring 344. After the holding member 32 has been placed on the horizontal surface via the support part 30 in the vertical direction, the first ring 342 secured to the shaft 34 has moved together with the shaft 34 inside the opening part H1 upward in the vertical direction, and the first ring 342 has came into contact with the side wall of the first bearing 321, when the holding member 32 is lifted from the horizontal surface at a predetermined distance, the second ring 344 secured to the shaft 34 moves together with the shaft 34 inside the opening part H2 downward in the vertical direction. As a result, the second ring 344 comes into contact with a side wall of the second bearing 322. As described above, the second bearing 322 serves a function of restricting the shaft 34 from moving toward the center inside the holding member 32.

In the exemplary embodiment, a position of the first ring 342 on the shaft 34 is set, while the second ring 344 is in contact with the second bearing 322, to a position at which a length Da from the first ring 342 to the first bearing 321 reaches a length equal to or above a length Db of a part of the shaft 34 when the part protrudes from the support part 30. On the other hand, a position of the second ring 344 on the shaft 34 is set, while the first ring 342 is in contact with the first bearing 321, to a position at which the second ring 344 is accommodated inside the opening part H2.

As described above, the shaft 34 is arranged inside the holding member 32, and is movable along the rotary axis AX inside the holding member 32. A range of movement of the shaft 34 along the rotary axis AX is restricted by the first ring 342 and the second ring 344. More specifically, the shaft 34 is movable along the rotary axis AX within a range from a position at which the second ring 344 is in contact with the second bearing 322 inside the opening part H2 to a position at which the first ring 342 is in contact with the first bearing 321 inside the opening part H1.

FIG. 5 illustrates, within the range of movement of the shaft 34, the shaft 34 arranged at the position at which the second ring 344 is in contact with the second bearing 322 inside the opening part H2. At this time, the end part, which is provided with the first ring 342, of the shaft 34 is in a state where a distance of protrusion from the rotation transmission part 48 is maximum. In the exemplary embodiment, a state where an end, which is provided with the first ring 342, of the shaft 34 protrudes from the surface of the rotation transmission part 48, i.e., the support part 30, is also referred to as a second state.

Figure 6:
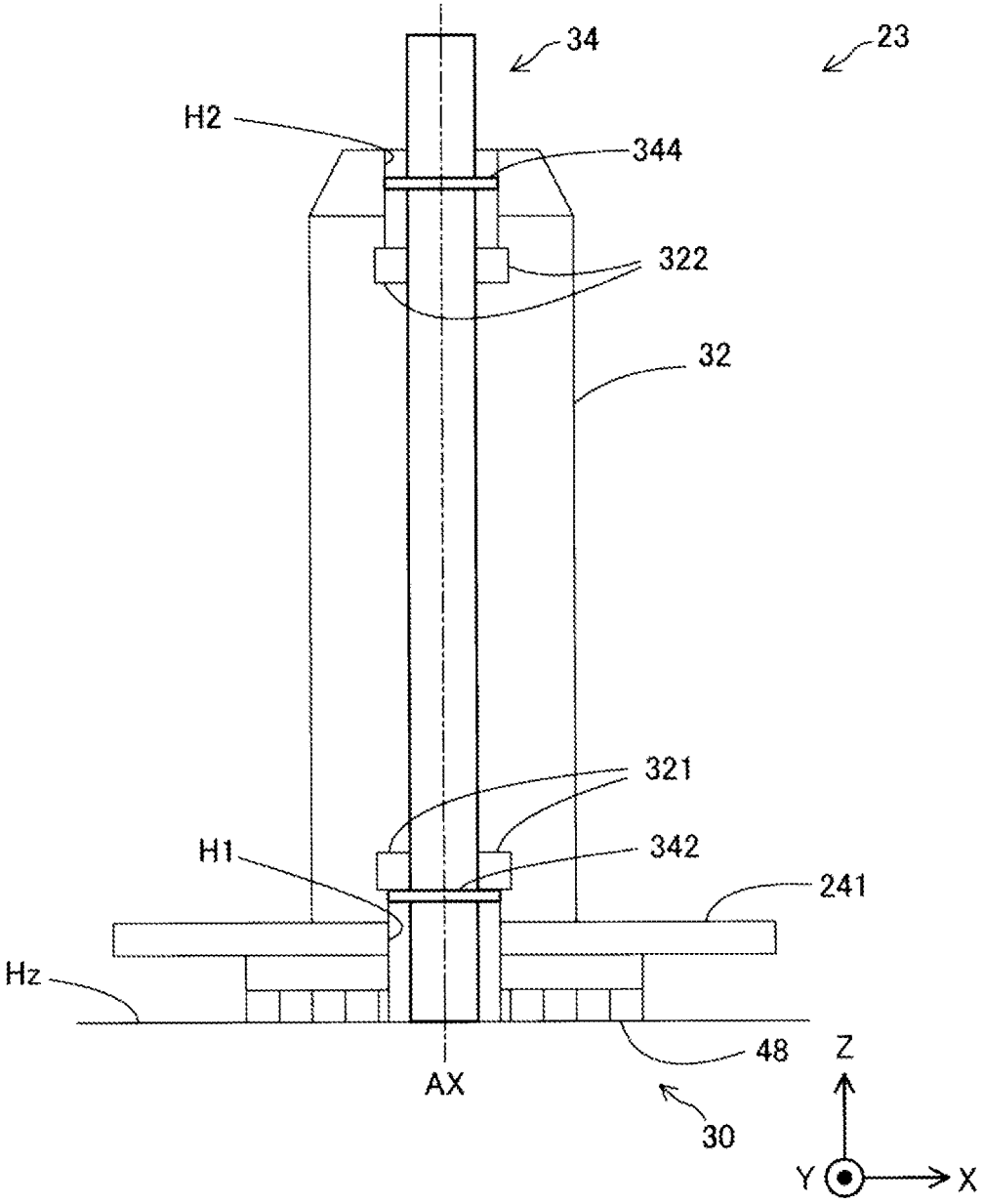
FIG. 6 is a cross-sectional view illustrating the internal structure of the roll medium feeding shaft when placed on a horizontal surface.

FIG. 6 is a cross-sectional view schematically illustrating the internal structure of the roll medium feeding shaft 23 when placed on the horizontal surface Hz via the support part 30. The cross-sectional view in FIG. 6 illustrates a section including the rotary axis AX of the roll medium feeding shaft 23. FIG. 6 schematically illustrates the horizontal surface Hz, in addition to other members of the roll medium feeding shaft 23. FIG. 6 illustrates a state where the rotary axis AX of the roll medium feeding shaft 23 is in the vertical direction, and the roll medium feeding shaft 23 is in contact with the horizontal surface Hz. That is, FIG. 6 schematically illustrates a state when the roll medium feeding shaft 23 is placed on the horizontal surface Hz.

FIG. 6 illustrates, within the range of movement of the shaft 34, the shaft 34 arranged at the position at which the first ring 342 is in contact with the first bearing 321 inside the opening part H1. When the roll medium feeding shaft 23 is placed on the horizontal surface Hz, the end of the shaft 34 is supported by the horizontal surface Hz. As described above, the shaft 34 is movable inside the roll medium feeding shaft 23 along the rotary axis AX. Therefore, the holding member 32 moves by its own weight downward in the vertical direction relative to the shaft 34 receiving an external force (effective force) from the horizontal surface Hz. The support part 30, i.e., the surface of the rotation transmission part 48, is in contact with the horizontal surface Hz to support the holding member 32 in the vertical direction.

As described above, the position of the first ring 342 on the shaft 34 is set, while the second ring 344 is in contact with the second bearing 322, to the position at which the distance from the first ring 342 to the first bearing 321 reaches a length equal to or above the length Db of the part of the shaft 34 when the part protrudes from the support part 30 (see FIG. 5). Therefore, when the holding member 32 moves downward in the vertical direction relative to the shaft 34, the holding member 32 can move until the end of the shaft 34 reaches a position at which the end of the shaft 34 does not protrude from the support part 30. In the exemplary embodiment, a state where the end, which is provided with the first ring 342, of the shaft 34 does not protrude from the support part 30 is also referred to as a first state.

As described above, the shaft 34 of the roll medium feeding shaft 23 according to the exemplary embodiment attains either the first state where the end of the shaft 34 does not protrude from the support part 30 of the roll medium feeding shaft 23 or the second state where the end of the shaft 34 protrudes from the support part 30. When the support part 30 is placed on the horizontal surface Hz, the shaft 34 attains the first state. Therefore, a user can place the support part 30 on the horizontal surface Hz to allow the roll medium feeding shaft 23 to be supported in the vertical direction. Therefore, the user can exchange the roll medium Ro in a state where the roll medium feeding shaft 23 is kept stable. Therefore, the user can exchange the roll medium Ro without allowing the roll medium Ro and the horizontal surface Hz to come into contact with each other, preventing the roll medium Ro from coming into contact with a work bench, and thus from becoming dirty or being damaged.

As described above, in the roll medium feeding shaft 23 according to the exemplary embodiment, the minimum value D2 of the width of the rotation transmission part 48 in the direction perpendicular to the rotary axis AX is set to be equal to or above the maximum value D1 of the width of the holding member 32 in the direction perpendicular to the rotary axis AX. That is, the rotation transmission part 48 having a width equal to or above the width of the holding member 32 serves as the support part 30. Therefore, compared with an aspect where the holding member 32 serves as the support part 30, the roll medium feeding shaft 23 can be further stably supported.

B. Second Exemplary Embodiment

Figure 7:
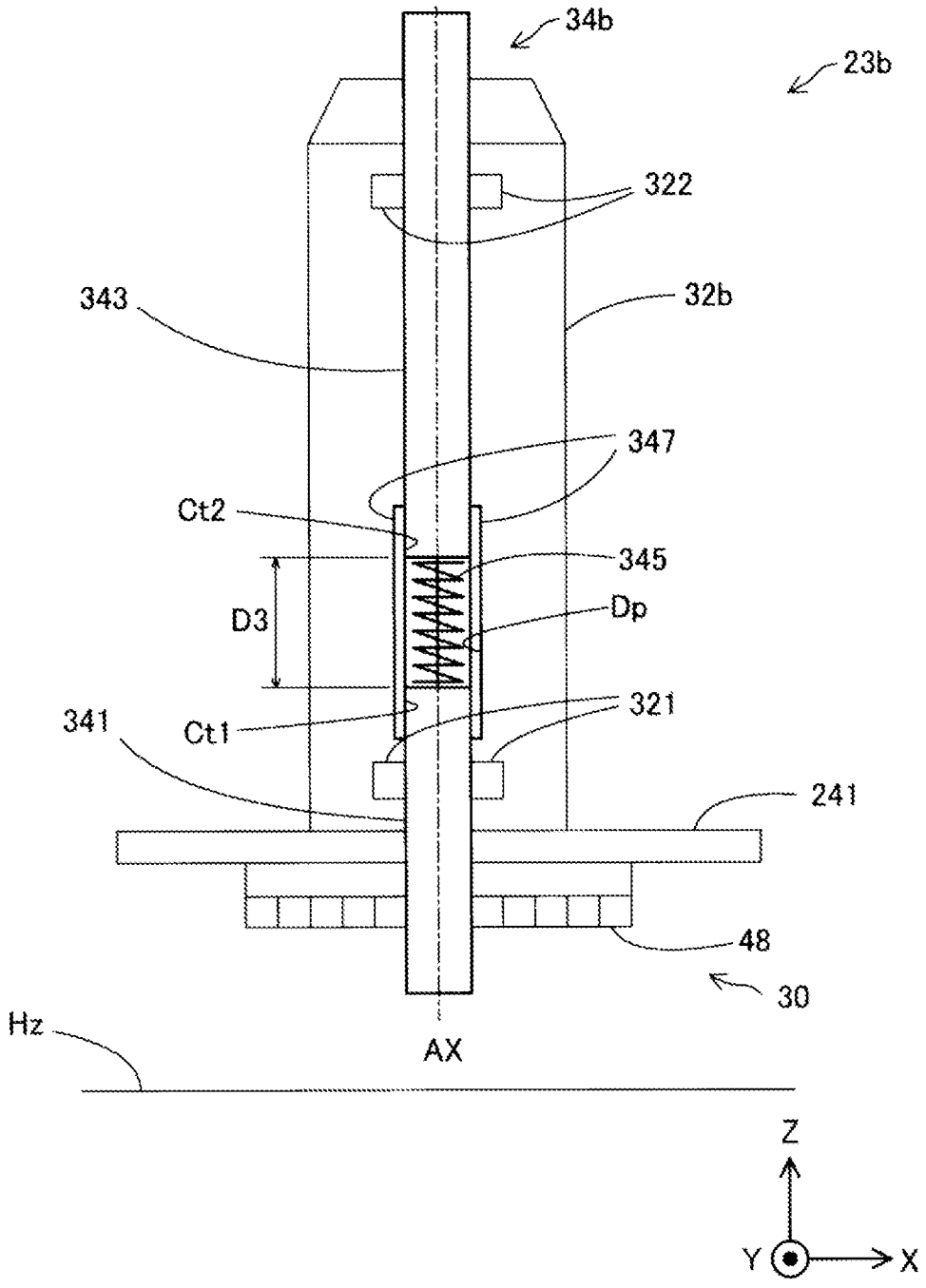
FIG. 7 is a cross-sectional view schematically illustrating an internal structure of a roll medium feeding shaft.

FIG. 7 is a cross-sectional view schematically illustrating an internal structure of a roll medium feeding shaft 23*b*. The cross-sectional view in FIG. 7 illustrates a surface including the rotary axis AX of the roll medium feeding shaft 23*b*. FIG. 7 schematically illustrates the horizontal surface Hz, in addition to other members of the roll medium feeding shaft 23*b*. FIG. 7 illustrates a state where the rotary axis AX of the roll medium feeding shaft 23*b* is in the vertical direction, and the roll medium feeding shaft 23*b* is not in contact with the horizontal surface Hz.

The roll medium feeding shaft 23*b* includes the first flange 241, the second flange 242, a holding member 32*b*, a shaft 34*b*, the rotation transmission part 48, and the support part 30. Note that the first flange 241, the second flange 242, the shaft 34*b*, the holding member 32*b*, and the rotation transmission part 48 rotate about the rotary axis AX. For ease of understanding of the technique, FIG. 7 does not illustrate the second flange 242.

The roll medium feeding shaft 23*b* according to the second exemplary embodiment is different in terms of that the shaft 34*b* is provided instead of the shaft 34 according to the first exemplary embodiment, the holding member 32*b* is provided instead of the holding member 32 according to the first exemplary embodiment, and the opening part H1 and the opening part H2 according to the first exemplary embodiment are not provided. Other configurations of the roll medium feeding shaft 23*b* are identical to corresponding configurations of the roll medium feeding shaft 23 according to the first exemplary embodiment.

The holding member 32*b* internally includes the first bearing 321 and the second bearing 322. The first bearing 321 and the second bearing 322 are secured inside the holding member 32*b*. The holding member 32*b* differs from the holding member 32 according to the first exemplary embodiment in terms of that the opening part H1 and the opening part H2 are not provided, but a concave Dp is provided. Other configurations of the holding member 32*b* are identical to corresponding configurations of the holding member 32 according to the first exemplary embodiment. The concave Dp is a void provided inside the holding member 32*b*, and is used to provide a cover 347 for the shaft 34*b*.

The shaft 34*b* includes a first shaft 341 including an end of the shaft 34*b*, a second shaft 343 including another end of the shaft 34*b*, a spring 345 serving as an elastic body, and the cover 347. The members are configured to be symmetry about a symmetry axis, i.e., about the rotary axis AX of the shaft 34*b*. That is, the shaft 34*b* is provided as a single shaft including the members described above, and is rotatable about the rotary axis AX inside the holding member 32*b*.

Upon application of a rotational force (external force) on the outer circumference from the feeding mechanism 45, the rotation transmission part 48 transmits rotation to the first flange 241 being coupled. The first flange 241 and the holding member 32*b* coupled to the first flange 241 receive rotation transmitted from the rotation transmission part 48 and rotate about the rotary axis AX around the shaft 34*b*. With the rotation, the roll medium Ro rotates, and the recording medium Sh is fed in the feeding direction.

The first shaft 341 and the second shaft 343 are shaft members. An end part of the first shaft 341 and an end part of the second shaft 343 face each other and are coupled via the spring 345. In a state where the spring 345 extends, the first shaft 341 and the second shaft 343 protrude from end parts of the holding member 32*b*. FIG. 7 illustrates the roll medium feeding shaft 23*b* being in the second state where the first shaft 341 including the end of the shaft 34*b* protrudes from the support part 30.

The spring 345 is arranged to be stretchable along the rotary axis AX. FIG. 7 illustrates a state when the spring 345 extends, as well as illustrates a length D3 when the spring 345 extends. When the spring 345 extends, the first shaft 341 protrudes from the support part 30 of the roll medium feeding shaft 23*b*, i.e., from the surface of the rotation transmission part 48. The length D3 at which the spring 345 extends is set to be a length equal to or above a length of a part of the first shaft 341 when the part protrudes from the support part 30.

The cover 347 is a cylindrical member configured to protect the spring 345. The cover 347 is engaged with the concave Dp of the holding member 32*b*. At this time, the cover 347 is arranged inside the holding member 32*b*, is rotatable about the rotary axis AX, and is immovable along the rotary axis AX.

FIG. 7 schematically illustrates an inner wall of the cover 347, specifically, an inner wall Ct1 to which the first shaft 341 is provided and an inner wall Ct2 to which the second shaft 343 is provided. The cover 347 and the second shaft 343 are secured to each other on the inner wall Ct2. Therefore, the second shaft 343 is immovable inside the holding member 32*b* along the rotary axis AX. On the other hand, the first shaft 341 is not secured to the inner wall Ct1 of the cover 347. Therefore, the first shaft 341 can move inside the cover 347 and inside the holding member 32*b* along the rotary axis AX.

As described above, in the roll medium feeding shaft 23*b* according to the exemplary embodiment, the shaft 34*b* is arranged to be rotatable inside the holding member 32*b*. As the spring 345 deforms, i.e., extends or contracts, the first shaft 341 of the shaft 34*b* can move along the rotary axis AX relative to the holding member 32*b*.

Figure 8:
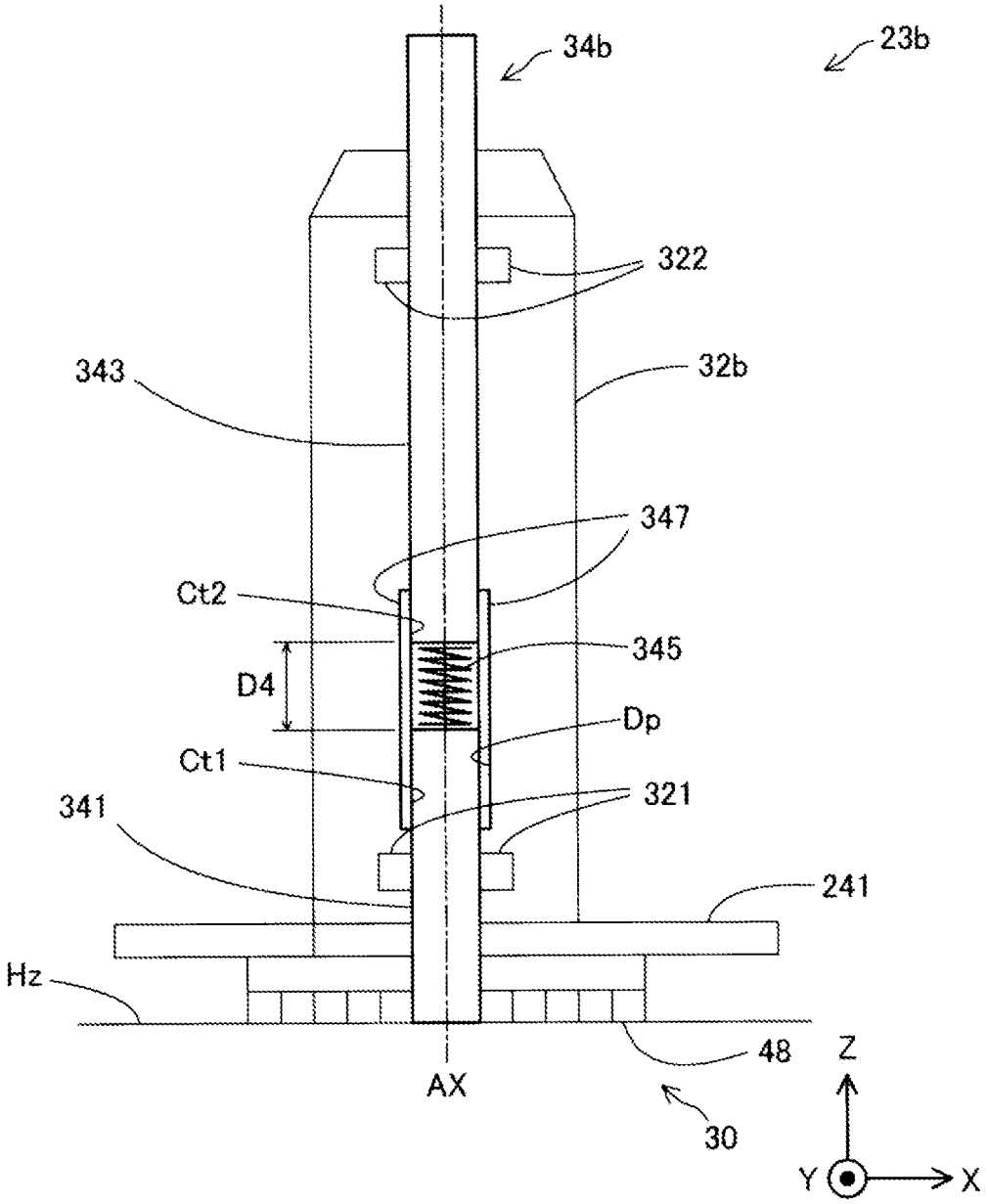
FIG. 8 is a cross-sectional view illustrating the internal structure of the roll medium feeding shaft when placed on a horizontal surface.

FIG. 8 is a cross-sectional view schematically illustrating the internal structure of the roll medium feeding shaft 23*b* when placed on the horizontal surface Hz via the support part 30 positioned. The cross-sectional view in FIG. 8 illustrates a surface including the rotary axis AX of the roll medium feeding shaft 23*b*. FIG. 8 schematically illustrates the horizontal surface Hz and a length D4 when the spring 345 contracts, in addition to other members of the roll medium feeding shaft 23*b*. FIG. 8 illustrates a state where the rotary axis AX of the roll medium feeding shaft 23*b* is in the vertical direction, and the roll medium feeding shaft 23*b* is in contact with the horizontal surface Hz. That is, FIG. 8 illustrates a state when the roll medium feeding shaft 23*b* is placed on the horizontal surface Hz.

As described above, as the spring 345 extends or contracts, the first shaft 341 of the shaft 34*b* can move along the rotary axis AX relative to the holding member 32*b*. When the roll medium feeding shaft 23*b* is placed on the horizontal surface Hz, the end of the shaft 34*b*, i.e., the first shaft 341, is supported by the horizontal surface Hz. On the other hand, the holding member 32*b* of the roll medium feeding shaft 23*b* causes the spring 345 to contract by its own weight and moves downward in the vertical direction. That is, the first shaft 341 moves upward in the vertical direction relative to the holding member 32*b* of the roll medium feeding shaft 23*b*, and is accommodated inside the roll medium feeding shaft 23*b*. The support part 30, i.e., the surface of the rotation transmission part 48, is in contact with the horizontal surface Hz to support the holding member 32*b* in the vertical direction.

A difference between the length D3 at which the spring 345 extends (see FIG. 7) and the length D4 at which the spring 345 contracts represents a length of the part of the first shaft 341 when the part protrudes from the support part 30, i.e., a distance at which the first shaft 341 has moved upon placement on the horizontal surface Hz.

As described above, when the support part 30 of the roll medium feeding shaft 23*b* is placed on the horizontal surface Hz, the first shaft 341 moves relative to the holding member 32*b* as the spring 345 deforms. Therefore, the shaft 34*b* attains the first state. At this time, an end of the first shaft 341 is supported by the horizontal surface Hz. The support part 30, i.e., the surface of the rotation transmission part 48, is in contact with the horizontal surface Hz to support the holding member 32*b* in the vertical direction. On the other hand, when the first shaft 341 is lifted away from the horizontal surface Hz, and thus receives no external force, for example, the spring 345 extends, the first shaft 341 protrudes from the support part 30, and the shaft 34*b* attains the second state.

As described above, with the roll medium feeding shaft 23*b* according to the second exemplary embodiment, the spring 345 can switch the shaft 34*b* from the first state to the second state. Therefore, a user can easily allow the shaft 34*b* to switch from the first state to the second state in order to exchange the roll medium Ro without allowing the roll medium Ro and the horizontal surface Hz to come into contact with each other.

C. Third Exemplary Embodiment

Figure 9:
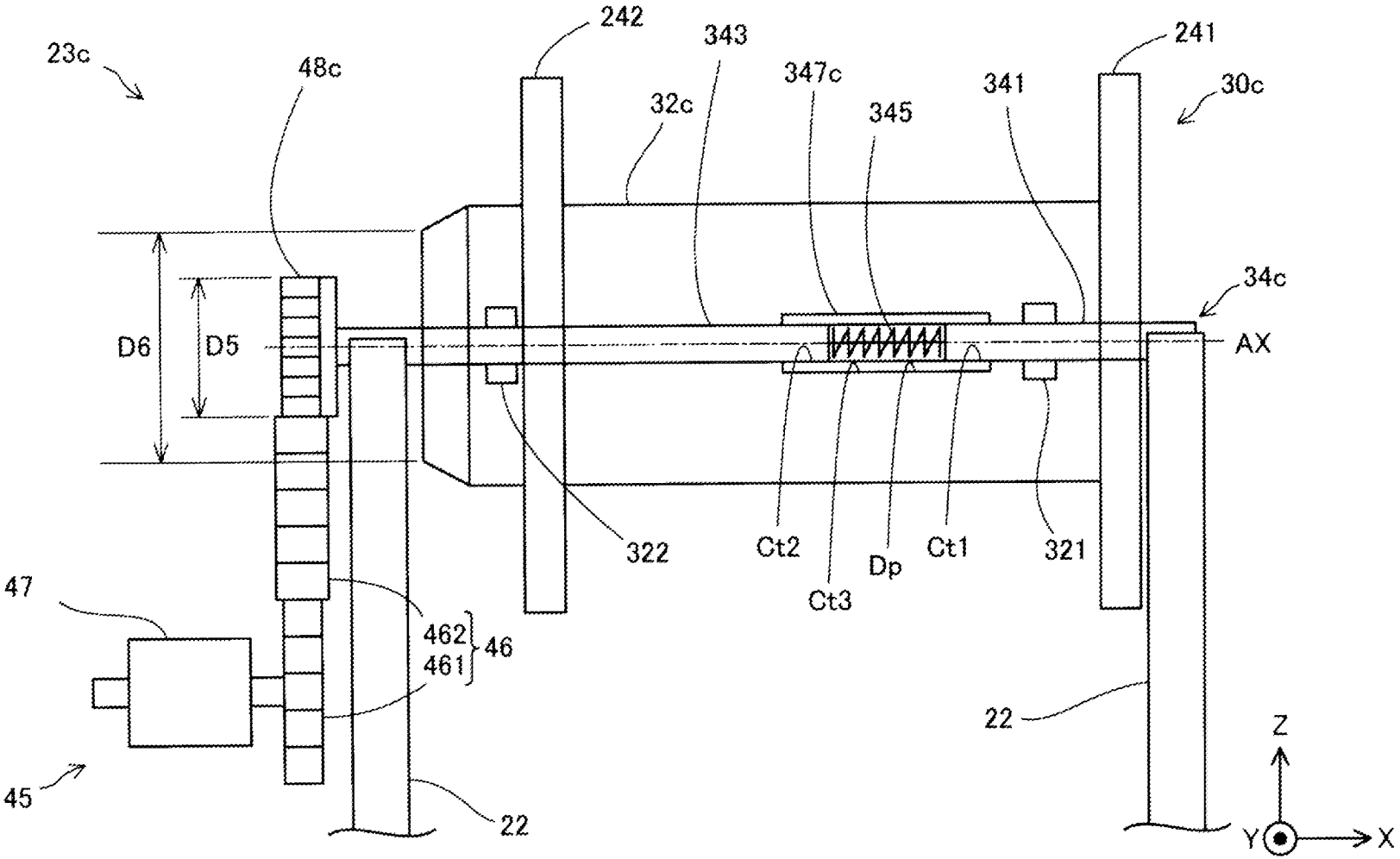
FIG. 9 is a side view schematically illustrating a configuration of a roll medium feeding shaft according to a third exemplary embodiment.

FIG. 9 is a side view schematically illustrating a configuration of a roll medium feeding shaft 23*c* according to a third exemplary embodiment. For ease of understanding of the technique, FIG. 9 further illustrates members that are hidden by other members lying on a front (Y direction) in the view and that are thus cannot be seen. FIG. 9 does not illustrate the roll medium Ro. FIG. 9 illustrates the rotary axis AX of the roll medium feeding shaft 23*c*, in addition to other members. FIG. 9 illustrates the roll medium feeding shaft 23*c* supported by the side walls 22.

The roll medium feeding shaft 23*c* according to the third exemplary embodiment includes the first flange 241, the second flange 242, a holding member 32*c*, a shaft 34*c*, a rotation transmission part 48*c*, and a support part 30*c*. Note that the first flange 241, the second flange 242, the shaft 34*c*, the holding member 32*c*, and the rotation transmission part 48*c* rotate about the rotary axis AX.

The roll medium feeding shaft 23*c* according to the third exemplary embodiment differs from the roll medium feeding shaft 23 according to the first exemplary embodiment in terms of that the support part 30*c* is provided instead of the support part 30, the holding member 32*c* is provided instead of the holding member 32, the shaft 34*c* is provided instead of the shaft 34, and the rotation transmission part 48*c* is provided instead of the rotation transmission part 48. Other configurations of the roll medium feeding shaft 23*c* are identical to corresponding configurations of the roll medium feeding shaft 23 according to the first exemplary embodiment.

The surface of the first flange 241 serves as the support part 30*c*. The surface is opposite to the surface secured to the holding member 32*c*. That is, in the roll medium feeding shaft 23*c* according to the exemplary embodiment, when the roll medium feeding shaft 23*c* is placed on a horizontal surface, the holding member 32*c* is supported in the vertical direction by the surface of the first flange 241.

The holding member 32*c* internally includes the first bearing 321 and the second bearing 322. The first bearing 321 and the second bearing 322 are secured inside the holding member 32*c*. The holding member 32*c* includes the concave Dp that is a void used to provide a cover 347*c* for the shaft 34*c*. FIG. 9 illustrates an inner wall Ct3 in the concave Dp of the holding member 32*c*. In the exemplary embodiment, the inner wall Ct3 in the concave Dp of the holding member 32*c* and an outer wall of the cover 347*c*, described later, of the shaft 34*c* are secured to each other. Other configurations of the holding member 32*c* are identical to corresponding configurations of the holding member 32*b* according to the second exemplary embodiment.

The shaft 34*c* includes the rotation transmission part 48*c*, the cover 347*c*, the first shaft 341 on an end of the shaft 34*c*, the second shaft 343 on another end of the shaft 34*c*, and the spring 345 serving as an elastic body. The shaft 34*c* is different in terms of that the rotation transmission part 48*c* and the cover 347*c* are provided instead of the rotation transmission part 48 and the cover 347*b* included in the shaft 34*b* according to the second exemplary embodiment. Other configurations of the shaft 34*c* are identical to corresponding configurations of the shaft 34*b* according to the second exemplary embodiment.

The rotation transmission part 48*c* is a substantially circular toothed gear, and is provided to an end part, which is opposite to the end part coupled to the spring 345, of the second shaft 343. That is, the rotation transmission part 48*c* is provided to an end part of the shaft 34*c*. The end part is opposite to an end part provided with the support part 30*c* of the roll medium feeding shaft 23*c*. An outer circumference part of the rotation transmission part 48*c* is coupled to the power transmission mechanism 46 of the feeding mechanism 45. Upon application of a rotational force (external force) on an outer circumference from the feeding mechanism 45, the rotation transmission part 48*c* transmits rotation to the second shaft 343 of the shaft 34*c*.

The cover 347*c* is a cylindrical member configured to protect the spring 345, and is engaged with the concave Dp of the holding member 32*c*. In the exemplary embodiment, the outer wall of the cover 347*c* is secured to the inner wall Ct3 of the holding member 32*c*. Therefore, the cover 347*c* rotates together with the holding member 32*c* about the rotary axis AX, and is immovable along the rotary axis AX.

The cover 347*c* and the second shaft 343 are secured to each other on the inner wall Ct2. On the other hand, the first shaft 341 is not secured to the inner wall Ct1 of the cover 347. The first shaft 341 can move inside the cover 347*c* and inside the holding member 32*c* as the spring 345 extends or contracts.

Upon application of an external force serving as a rotational force on the outer circumference from the feeding mechanism 45, the rotation transmission part 48*c* transmits rotation to the second shaft 343 of the shaft 34*c*. The second shaft 343 rotates about the rotary axis AX together with the cover 347*c* secured to the second shaft 343, the holding member 32*c* secured to the cover 347*c*, the first flange 241 secured to the holding member 32*c*, and the first shaft 341 coupled to the second shaft 343 via the spring 345. With the rotation, the roll medium Ro rotates, and the recording medium Sh is fed in the feeding direction.

In the exemplary embodiment, the spring 345 switches the shaft 34*c* between the first state and the second state, similar to the roll medium feeding shaft 23*b* according to the second exemplary embodiment. More specifically, when the surface of the first flange 241, i.e., the support part 30*c* of the roll medium feeding shaft 23*c*, is placed on the horizontal surface Hz, the first shaft 341 moves relative to the holding member 32*c* as the spring 345 deforms. Therefore, the shaft 34*c* attains the first state. At this time, an end of the first shaft 341 is supported by the horizontal surface Hz. The support part 30*c*, i.e., the surface of the first flange 241, is in contact with the horizontal surface Hz to support the holding member 32*c* in the vertical direction. On the other hand, without having received an external force, the spring 345 extends, the first shaft 341 protrudes from the support part 30*c*, and the shaft 34*c* attains the second state.

Therefore, a user can place the support part 30*c* on the horizontal surface Hz, and exchange the roll medium Ro in a state where the holding member 32*c* of the roll medium feeding shaft 23*c* is supported in the vertical direction. Therefore, the user can exchange the roll medium Ro without allowing the roll medium Ro and the horizontal surface Hz to come into contact with each other.

FIG. 9 illustrates a maximum value D5 of a width of the rotation transmission part 48*c* and a minimum value D6 of a width of the holding member 32*c*, in addition to other members. The maximum value D5 of the width of the rotation transmission part 48*c* represents a maximum value of the width of the rotation transmission part 48*c* in the direction perpendicular to the rotary axis AX of the rotation transmission part 48*c*. More specifically, the maximum value D5 of the width of the rotation transmission part 48*c* represents a diameter of a circle having a maximum diameter among circles externally abutting an external shape of the rotation transmission part 48*c* in the direction perpendicular to the rotary axis AX.

The minimum value D6 of the width of the holding member 32*c* represents a minimum value of the width of the holding member 32*c* in the direction perpendicular to the rotary axis AX of the holding member 32*c*. More specifically, the minimum value D6 of the width of the holding member 32*c* represents a diameter of a circle having a minimum diameter among circles internally abutting an external shape of the holding member 32*c* in the direction perpendicular to the rotary axis AX.

In the roll medium feeding shaft 23*c* according to the exemplary embodiment, the maximum value D5 of the width of the rotation transmission part 48*c* in the direction perpendicular to the rotary axis AX is smaller than the minimum value D6 of the width of the holding member 32*c* in the direction perpendicular to the rotary axis AX. That is, with the roll medium feeding shaft 23*c* according to the exemplary embodiment, the rotation transmission part 48*c* having a width smaller than the width of the holding member 32*c* is provided to the end part opposite to the end part provided with the support part 30*c*. Therefore, even when the rotation transmission part 48*c* is further small-sized, the roll medium feeding shaft 23*c* can be stably supported.

D. Fourth Exemplary Embodiment

Figure 10:
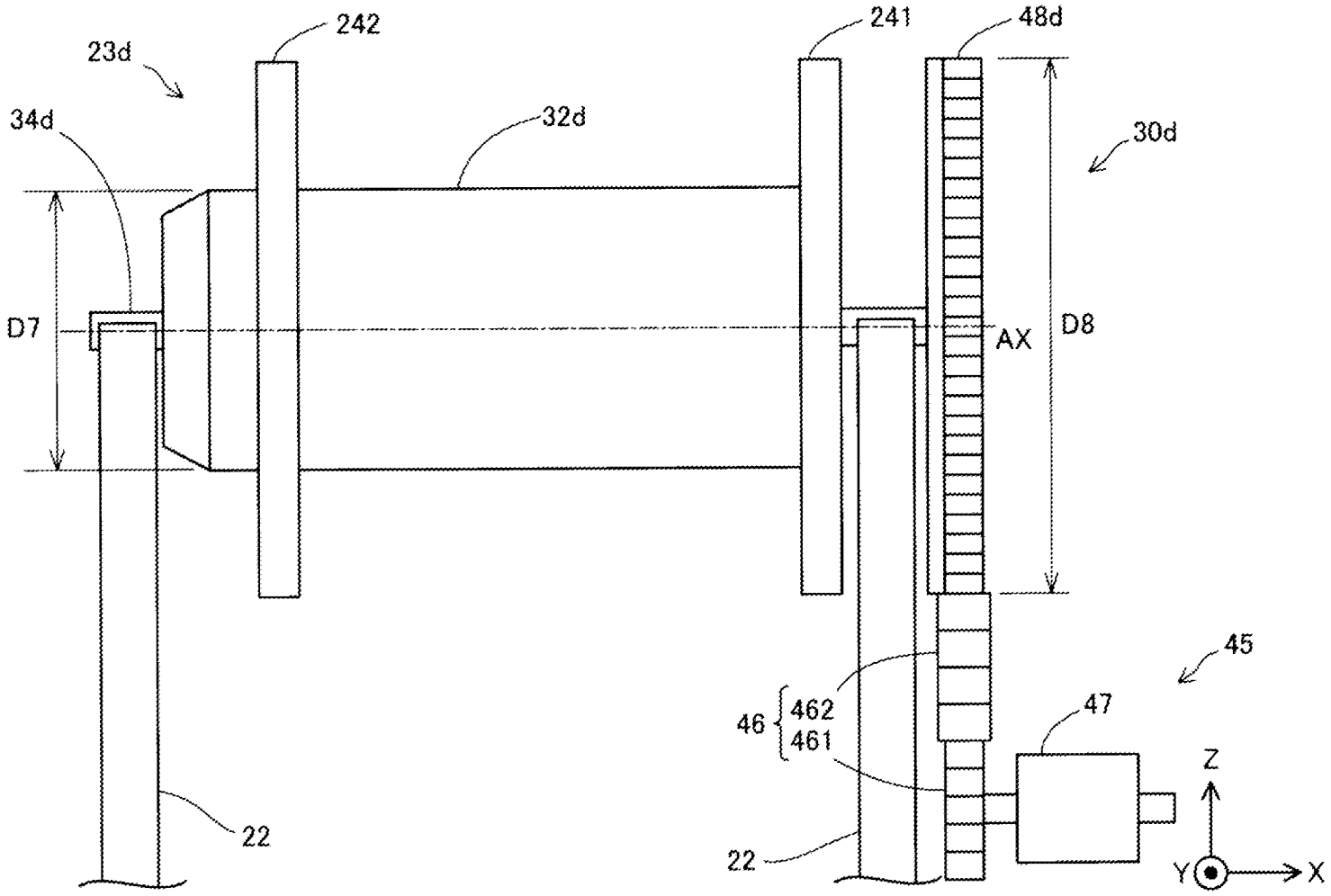
FIG. 10 is a side view schematically illustrating a structure of a roll medium feeding shaft according to a fourth exemplary embodiment.

FIG. 10 is a side view schematically illustrating a structure of a roll medium feeding shaft 23*d* according to a fourth exemplary embodiment. FIG. 10 does not illustrate the roll medium Ro. FIG. 10 illustrates the rotary axis AX of the roll medium feeding shaft 23*d*, in addition to other members. FIG. 10 illustrates the roll medium feeding shaft 23*d* supported by the side walls 22.

The roll medium feeding shaft 23*d* according to the fourth exemplary embodiment includes the first flange 241, the second flange 242, a holding member 32*d*, a shaft 34*d*, a rotation transmission part 48*d*, and a support part 30*d*. The shaft 34*d*, the first flange 241, the second flange 242, the holding member 32*d*, and the rotation transmission part 48*d* rotate about the rotary axis AX.

The roll medium feeding shaft 23*d* according to the fourth exemplary embodiment is different in terms of that the holding member 32*d* is provided instead of the holding member 32 according to the first exemplary embodiment, the shaft 34*d* is provided instead of the shaft 34 according to the first exemplary embodiment, the rotation transmission part 48*d* is provided instead of the rotation transmission part 48 according to the first exemplary embodiment, and the support part 30*d* is provided instead of the support part 30 according to the first exemplary embodiment. Other configurations of the roll medium feeding shaft 23*d* are identical to corresponding configurations of the roll medium feeding shaft 23 according to the first exemplary embodiment.

The shaft 34*d* is a shaft member provided inside the holding member 32*d*. An end part of the shaft 34*d* is coupled to the rotation transmission part 48*d*. The shaft 34*d* does not pass through the rotation transmission part 48*d*. That is, among surfaces of the rotation transmission part 48*d*, the shaft 34*d* does not protrude from the surface opposite to the surface coupled to the shaft 34*d*.

The first flange 241 is secured to an end part in the X direction of the holding member 32*d*. In the exemplary embodiment, the first flange 241 is secured to the shaft 34*d*. Therefore, the shaft 34*d* does not move along the rotary axis AX.

The rotation transmission part 48*d* is a substantially circular toothed gear, and is provided to the end part, which is provided with the first flange 241, of the shaft 34*d*. An outer circumference part of the rotation transmission part 48*d* is coupled to the power transmission mechanism 46 of the feeding mechanism 45. Upon application of a rotational force (external force) on an outer circumference from the feeding mechanism 45, the rotation transmission part 48*d* transmits rotation to the shaft 34*d*. Upon reception of rotation, the shaft 34*d* rotates about the rotary axis AX together with the first flange 241 secured to the holding member 32*d*. With the rotation, the roll medium Ro rotates, and the recording medium Sh is fed in the feeding direction.

The surface of the rotation transmission part 48*d* serves as the support part 30*d*. The surface is opposite to the surface coupled to the shaft 34*d*. That is, when the roll medium feeding shaft 23*d* is placed on a horizontal surface, the holding member 32*d* according to the exemplary embodiment is supported in the vertical direction by the surface of the rotation transmission part 48*d*.

FIG. 10 illustrates a maximum value D7 of a width of the holding member 32*d* and a minimum value D8 of a width of the rotation transmission part 48*d*, in addition to other members. The maximum value D7 of the width of the holding member 32*d* represents a maximum value of the width of the holding member 32*d* in the direction perpendicular to the rotary axis AX of the holding member 32*d*. More specifically, the maximum value D7 of the width of the holding member 32*d* represents a diameter of a circle having a maximum diameter among circles externally abutting an external shape of the holding member 32*d* in the direction perpendicular to the rotary axis AX.

The minimum value D8 of the width of the rotation transmission part 48*d* represents a minimum value of the width of the rotation transmission part 48*d* in the direction perpendicular to the rotary axis AX of the rotation transmission part 48*d*. More specifically, the minimum value D8 of the width of the rotation transmission part 48*d* represents a diameter of a circle having a minimum diameter among circles internally abutting an external shape of the rotation transmission part 48*d* in the direction perpendicular to the rotary axis AX.

In the roll medium feeding shaft 23*d* according to the exemplary embodiment, the minimum value D8 of the width of the rotation transmission part 48*d* in the direction perpendicular to the rotary axis AX is set to be equal to or above the maximum value D7 of the width of the holding member 32*d* in the direction perpendicular to the rotary axis AX. Therefore, the rotation transmission part 48*d* having a width equal to or above the width of the holding member 32*d* serves as the support part 30*d*. Therefore, compared with an aspect where the holding member 32*d* serves as the support part 30*d*, the roll medium feeding shaft 23*d* can be further stably supported.

In the roll medium feeding shaft 23*d* according to the exemplary embodiment, the rotation transmission part 48*d* provided to the end part of the shaft 34*d* serves as the support part 30*d*. That is, a user can place the rotation transmission part 48*d* on a horizontal surface, and exchange the roll medium Ro in a state where the roll medium feeding shaft 23*d* is supported in the vertical direction. Therefore, the user can exchange the roll medium Ro without allowing the roll medium Ro and the horizontal surface to come into contact with each other.

E. Fifth Exemplary Embodiment

Figure 11:
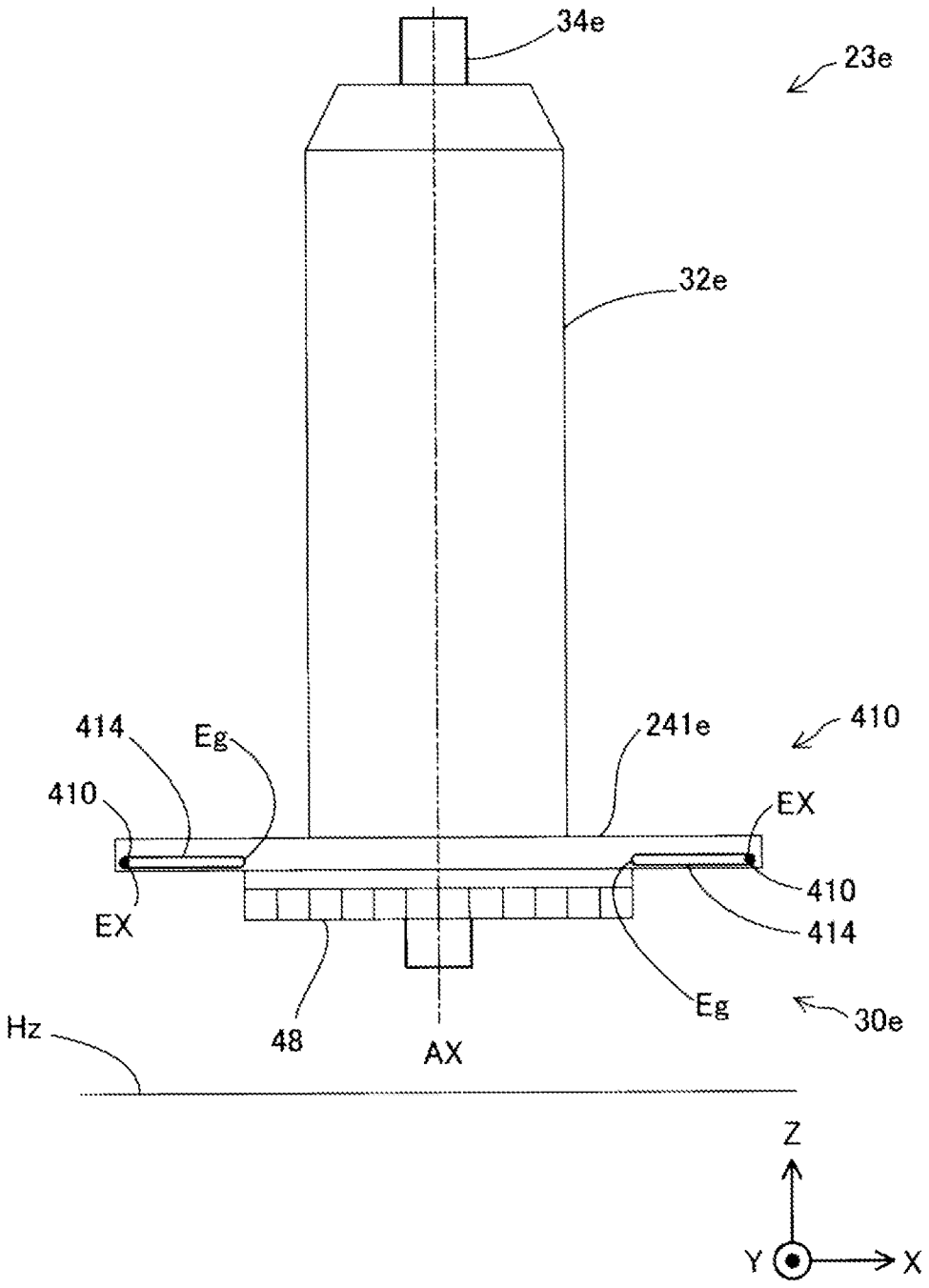
FIG. 11 is a side view schematically illustrating a structure of a roll medium feeding shaft according to a fifth exemplary embodiment.

FIG. 11 is a side view schematically illustrating a structure of a roll medium feeding shaft 23*e* according to a fifth exemplary embodiment. FIG. 11 does not illustrate the roll medium Ro. FIG. 11 schematically illustrates the rotary axis AX of the roll medium feeding shaft 23*e* and the horizontal surface Hz, in addition to other members. FIG. 11 illustrates a state where the rotary axis AX of the roll medium feeding shaft 23*e* is in the vertical direction, and the roll medium feeding shaft 23*e* is not in contact with the horizontal surface Hz.

The roll medium feeding shaft 23*e* according to the fifth exemplary embodiment includes a shaft 34*e*, a first flange 241*e*, the second flange 242, a support part 30*e*, a holding member 32*e*, and the rotation transmission part 48. The first flange 241*e*, the second flange 242, the shaft 34*e*, the holding member 32*e*, and the rotation transmission part 48 rotate about the rotary axis AX. For ease of understanding of the technique, FIG. 11 does not illustrate the second flange 242.

The roll medium feeding shaft 23*e* is different in terms of that the holding member 32*e* is provided instead of the holding member 32 according to the first exemplary embodiment, the shaft 34*e* is provided instead of the shaft 34 according to the first exemplary embodiment, the first flange 241*e* is provided instead of the first flange 241 according to the first exemplary embodiment, and the support part 30*e* is provided instead of the support part 30 according to the first exemplary embodiment. Other configurations of the roll medium feeding shaft 23*e* are identical to corresponding configurations of the roll medium feeding shaft 23 according to the first exemplary embodiment.

The shaft 34*e* is a shaft member rotatably provided inside the holding member 32*e*. In the exemplary embodiment, the shaft 34*e* does not move along the rotary axis AX. The shaft 34*e* may be a separate component from the roll medium feeding shaft 23*e*, as well as may not be a part of the roll medium feeding shaft 23*e*.

The first flange 241*e* is provided to an end part of the holding member 32*e* to allow respective surfaces to orient in the direction perpendicular to the rotary axis AX. In the exemplary embodiment, the first flange 241*e* internally includes support legs 414. A specific configuration of the first flange 241*e* will be described later.

The support part 30*e* is a part of the roll medium feeding shaft 23*e*, and is configured to support, when the roll medium feeding shaft 23*e* is placed on a horizontal surface, the holding member 32*e* in the vertical direction. The support part 30*e* is provided to an end of the roll medium feeding shaft 23*e*. A specific configuration of the support part 30*e* will be described later.

The rotation transmission part 48 is a substantially circular toothed gear, and is coupled to the surface of the first flange 241*e*. The surface is opposite to a surface provided with the holding member 32*e*. Upon application of a rotational force (external force) on the outer circumference from the feeding mechanism 45 (not illustrated in FIG. 11), the rotation transmission part 48 transmits rotation to the first flange 241*e*. With the rotation, the first flange 241*e* rotates about the rotary axis AX together with the holding member 32*e* being coupled. With the rotation, the roll medium Ro rotates, and the recording medium Sh is fed in the feeding direction.

Figure 12:
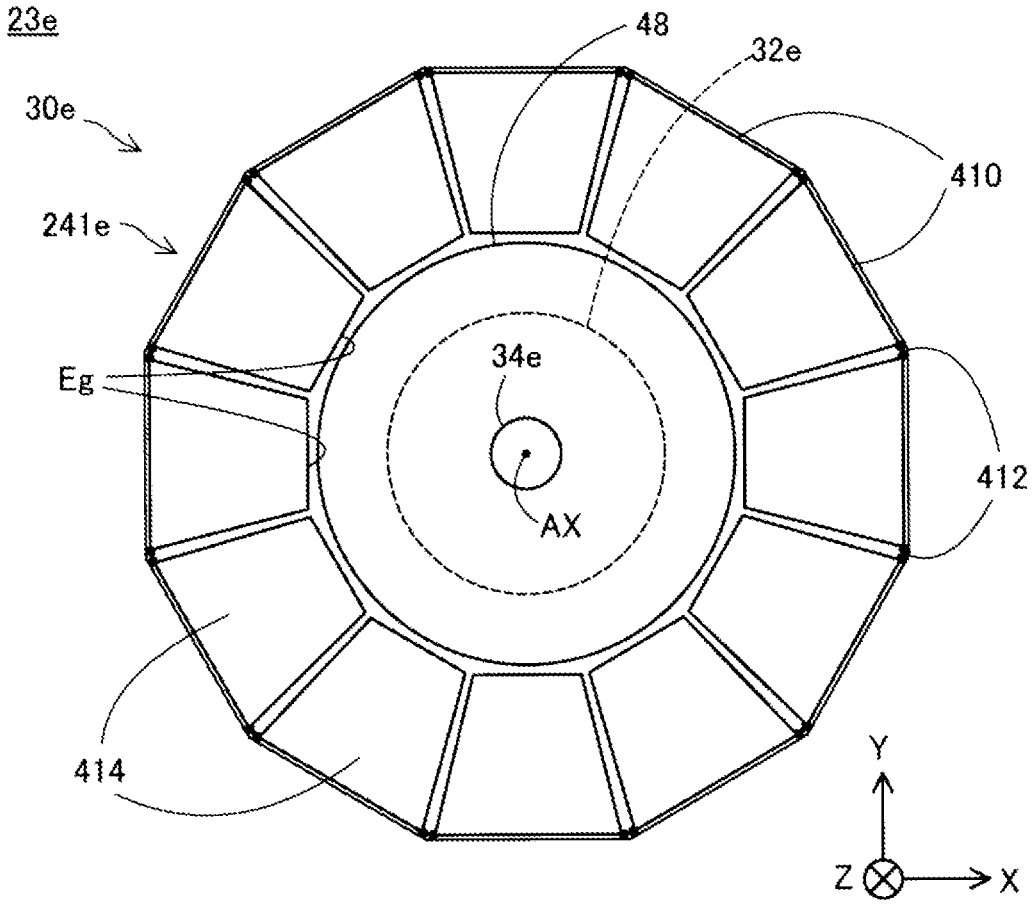
FIG. 12 is a front view illustrating a configuration of a first flange when support legs are at a first position.

FIG. 12 is a front view illustrating the configuration of the first flange 241*e* when the support legs 414 are at a first position. FIG. 12 illustrates the front view when the roll medium feeding shaft 23*e* having the rotary axis AX in parallel to the vertical direction is viewed from above in the vertical direction.

The support legs 414 are plate members provided inside the first flange 241*e*. In the exemplary embodiment, a number of the support legs 414 is 12. The support legs 414 include shafts 410 and couplers 412.

The shafts 410 are shaft members provided along sides of the support legs 414, i.e., provided adjacent to an outer circumference of the first flange 241*e*. The shafts 410 respectively allow the support legs 414 to rotate within a predetermined range about rotary axes EX of the shafts 410 (see FIG. 11). More specifically, the support legs 414 can rotate within a range between the first position inside the first flange 241*e* and a second position outside the first flange 241*e* when rotated about the rotary axes EX of the shafts 410. At the first position, the support legs 414 are secured inside the first flange 241*e*, and are thus integral with the first flange 241*e*. FIGS. 11 and 12 illustrate the support legs 414 being at the first position. A configuration of the support legs 414 being at the second position will be described later. The support legs 414 can be secured at either of the first position and the second position.

The couplers 412 are flexible joints (also referred to as universal joints) provided at both ends of the shafts 410. The couplers 412 secure end parts of the shafts 410 of the support legs 414 adjacent to each other to each other. With the securing style, when a user intends to switch a plurality of the support legs 414 between the first position and the second position described later, the user can operate just one of the support legs 414 to simultaneously switch all the support legs 414, for example.

Figure 13:
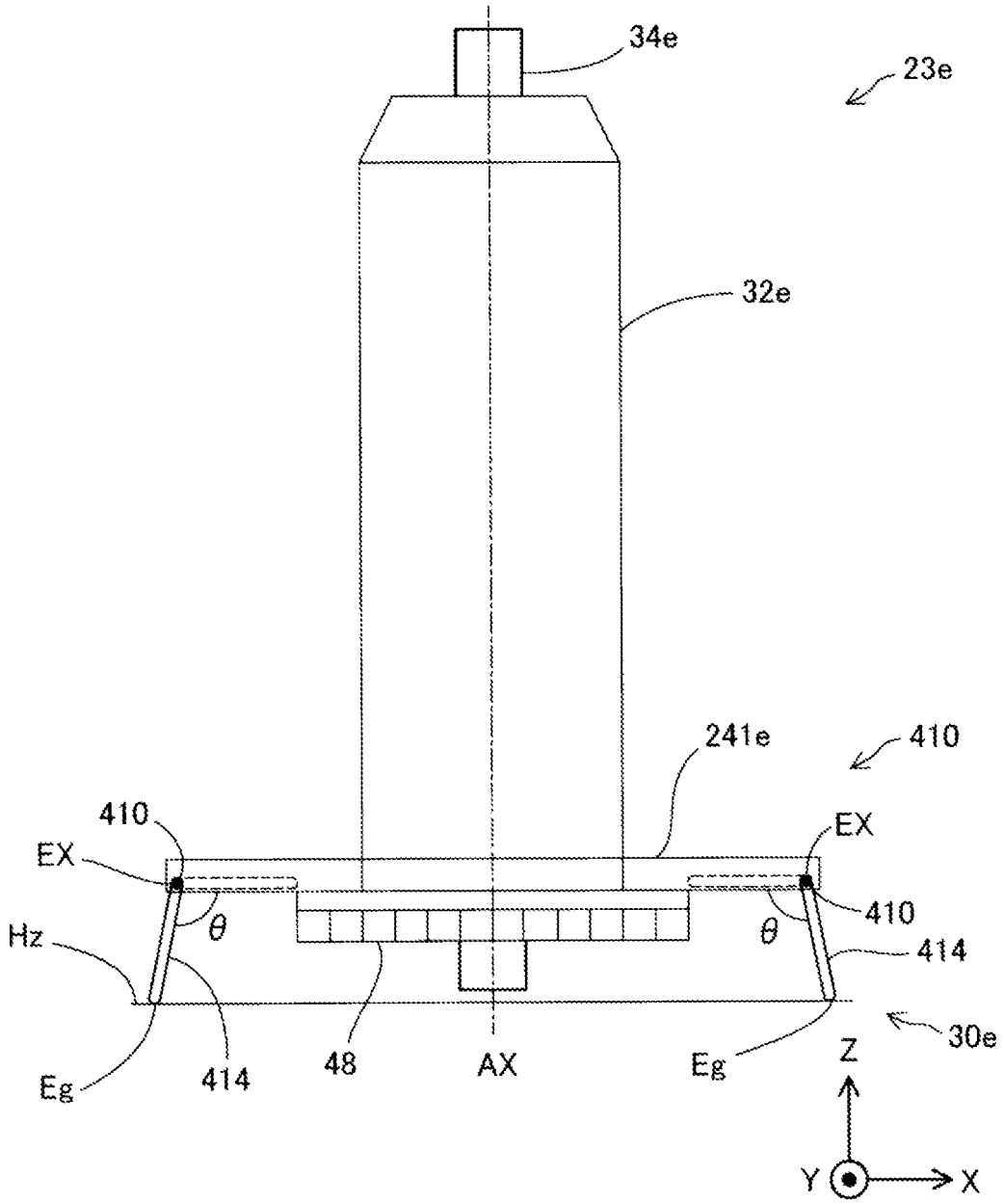
FIG. 13 is a side view illustrating a configuration of the first flange when the support legs are at a second position.

FIG. 13 is a side view illustrating the configuration of the first flange 241*e* when the support legs 414 are at the second position. In FIG. 13, dashed lines inside the first flange 241*e* schematically illustrate positions of the support legs 414 being at the first position (see FIG. 11). FIG. 13 schematically illustrates end parts Eg on other ends of the support legs 414 and the rotary axes EX of the shafts 410, in addition to other members. The end parts Eg are end parts of the support legs 414. The end parts are opposite to end parts provided with the shafts 410.

The support legs 414 can rotate about the rotary axes EX of the shafts 410 (see FIG. 11), as described above, to switch from the first position provided inside the first flange 241*e* to the second position provided outside the first flange 241*e*. When the support legs 414 are arranged at the second position, the end parts Eg of the support legs 414 are at outermost positions of the roll medium feeding shaft 23*e*.

In the specification, the state "at the outermost positions of the roll medium feeding shaft 23*e*" denotes a state where parts of the support legs 414 being at the second position are outermost of the roll medium feeding shaft 23*e*. More specifically, when the roll medium feeding shaft 23*e* is projected onto a horizontal surface to allow the rotary axis AX to be in parallel to the vertical direction, the support legs 414 are outermost of the roll medium feeding shaft 23*e*. In the roll medium feeding shaft 23*e* according to the exemplary embodiment, the end parts Eg of the support legs 414 are arranged outside an end of the shaft 34*e* being at the first position (see FIG. 11). That is, the end parts Eg of the support legs 414 reach outermost of the roll medium feeding shaft 23*e*.

In the exemplary embodiment, the support part 30*e* includes the end parts Eg of the plurality of support legs 414. When the roll medium feeding shaft 23*e* is placed on the horizontal surface Hz, the end parts Eg of the plurality of support legs 414 support the holding member 32*e* in the vertical direction. Therefore, the number of the support legs 414 is 12 in the exemplary embodiment. However, the invention is not limited to the number. It is more preferable that the number of the support legs 414 be three or more for configuring a single surface.

FIG. 13 illustrates an angle θ at which the support legs 414 rotate about the rotary axes EX. In the exemplary embodiment, the angle θ is equal to or above 90 degrees. Therefore, the end parts Eg of the support legs 414 being at the second position can be arranged outside the end parts adjacent to the outer circumference of the first flange 241*e* (outside in the X direction in FIG. 13). Therefore, compared with an aspect where, at the second position, the support legs 414 are provided in the vertical direction, the holding member 32*e* can be further stably supported.

As described above, with the roll medium feeding shaft 23*e* according to the exemplary embodiment, the holding member 32*e* of the roll medium feeding shaft 23*e* can be supported by the support legs 414 in the vertical direction. Therefore, a user can exchange the roll medium Ro without allowing the roll medium Ro and the horizontal surface Hz to come into contact with each other.

F. Other Exemplary Embodiments (F1) In the first exemplary embodiment described above, the maximum value D1 of the width represents a diameter of a circle having a maximum diameter among circles externally abutting the external shape of the holding member 32 in the direction perpendicular to the rotary axis AX. However, the maximum value D1 of the width may be an average value of diameters of circles externally abutting an external shape of a holding member. In the aspect, even when the holding member has an external shape having a part greatly protruding outward, for example, effects similar to the effects described above can be achieved.

(F2) In the first exemplary embodiment described above, the minimum value D2 of the width of the rotation transmission part 48 represents a diameter of a circle having a minimum diameter among circles internally abutting the external shape of the rotation transmission part 48 in the direction perpendicular to the rotary axis AX. However, the minimum value D2 of the width may be an average value of diameters of circles internally abutting an external shape of a rotation transmission part. In the aspect, even in an aspect where a rotation transmission part has an external shape having a part greatly protruding inward, for example, effects similar to the effects described above can be achieved.

(F3) In the third exemplary embodiment described above, the shaft 34*c* includes the rotation transmission part 48*c*, the cover 347*c*, the first shaft 341 on the end of the shaft 34*c*, the second shaft 343 on the other end of the shaft 34*c*, and the spring 345 serving as an elastic body. However, the shaft 34*c* may take an aspect where the cover 347*c*, the first shaft 341 on the end of the shaft 34*c*, the second shaft 343 on the other end of the shaft 34*c*, and the spring 345 serving as an elastic body are not included. In the aspect, the shaft 34 according to the first exemplary embodiment, which includes the first ring 342 and the second ring 344, can be adopted, for example. When the shaft 34 is in the second state, the shaft 34 may be at least secured with a holding member or a first flange to transmit rotation from the rotation transmission part 48*c* to the holding member. Even with the aspect described above, effects similar to the effects described above can be achieved.

(F4) In the third exemplary embodiment described above, the maximum value D5 of the width of the rotation transmission part 48*c* represents a diameter of a circle having a maximum diameter among circles externally abutting the external shape of the rotation transmission part 48*c* in the direction perpendicular to the rotary axis AX. However, the maximum value D5 of the width may be an average value of diameters of circles externally abutting an external shape of a rotation transmission part. In the aspect, even when the rotation transmission part has an external shape having a part greatly protruding outward, for example, effects similar to the effects described above can be achieved.

(F5) In the third exemplary embodiment described above, the minimum value D6 of the width of the holding member 32*c* represents a diameter of a circle having a minimum diameter among circles internally abutting the external shape of the holding member 32*c* in the direction perpendicular to the rotary axis AX. However, the minimum value D6 of the width may be an average value of diameters of circles internally abutting an external shape of a holding member. In the aspect, even in an aspect where a holding member has an external shape having a part greatly protruding inward, for example, effects similar to the effects described above can be achieved.

(F6) In the fourth exemplary embodiment described above, the maximum value D7 of the width of the holding member 32*d* represents a diameter of a circle having a maximum diameter among circles externally abutting the external shape of the holding member 32*d* in the direction perpendicular to the rotary axis AX. However, the maximum value D7 of the width may be an average value of diameters of circles externally abutting an external shape of a holding member. In the aspect, even when the holding member has an external shape having a part greatly protruding outward, for example, effects similar to the effects described above can be achieved.

(F7) In the fourth exemplary embodiment described above, the minimum value D8 of the width of the rotation transmission part 48*d* represents a diameter of a circle having a minimum diameter among circles internally abutting the external shape of the rotation transmission part 48*d* in the direction perpendicular to the rotary axis AX. The minimum value D8 of the width may be an average value of diameters of circles internally abutting an external shape of a rotation transmission part. In the aspect, even in an aspect where a rotation transmission part has an external shape having a part greatly protruding inward, for example, effects similar to the effects described above can be achieved.

(F8) In the fifth exemplary embodiment described above, the support legs 414 are plate members provided inside the first flange 241*e*. However, the support legs are not limited to plate members, but may be bar members, for example. In the aspect, it is more preferable that the number of the support legs be three or more to form a single surface. Even with the aspect described above, effects similar to the effects described above can be achieved.

(F9) In the fifth exemplary embodiment described above, the roll medium feeding shaft 23*e* includes the rotation transmission part 48. However, the roll medium feeding shaft 23*e* may take an aspect where the rotation transmission part 48 is not included. In the aspect, such an aspect that the power transmission mechanism causes the holding member 32*e* to rotate can be adopted. Even with the aspect described above, effects similar to the effects described above can be achieved.

G. Other Aspects

The invention is not limited to the exemplary embodiments described above, and can be realized in various aspects without departing from the gist of the invention. For example, the invention can be achieved in aspects described below. Technical features in the above-described exemplary embodiments, which correspond to the technical features in the aspects described below, can appropriately be replaced or combined to address some or all of the issues to be solved by the invention or to achieve some or all of the effects of the invention. Additionally, when the technical features are not described herein as essential technical features, such technical features may be deleted appropriately.

(1) According to an aspect of the invention, a roll medium feeding shaft to be inserted into a through hole of a roll medium formed by winding a long recording medium is provided. The roll medium feeding shaft includes a holding member configured to be inserted into the through hole and to be rotated about a rotary axis together with the roll medium, a support part provided to one end of the roll medium feeding shaft and configured to support the holding member in a vertical direction when placed on a horizontal surface, and a shaft provided inside the holding member and configured to be movable inside the holding member along the rotary axis. The shaft is configured to be in one of a first state where the one end of the shaft does not protrude from the support part and a second state where the one end of the shaft protrudes from the support part. When the one end of the shaft is oriented downward in the vertical direction and the support part is placed on the horizontal surface, the shaft is in the first state. With the roll medium feeding shaft according to the aspect, when a support part of a roll medium feeding shaft is placed on a horizontal surface, the one end of the shaft does not protrude from the support part to attain a first state. That is, a user can place the support part on a horizontal surface to allow the roll medium feeding shaft to be supported in the vertical direction. Therefore, the user can exchange the roll medium in a state where the roll medium feeding shaft is kept stable. Therefore, the user can exchange the roll medium without allowing the roll medium and the horizontal surface to come into contact with each other, preventing the roll medium from coming into contact with a work bench, and thus from becoming dirty or being damaged. In here, the first state where the one end of the shaft does not protrude from the support part is not limited to a state where the one end of the shaft does not fully protrude from the support part. The first state may include a state where the one end of the shaft protrudes from the support part approximately several millimeters (e.g., below five millimeters). The reason is that, as long as one end of a roll medium feeding shaft protrudes from a support part approximately several millimeters, even when the support part of the roll medium feeding shaft is placed on a horizontal surface, the roll medium feeding shaft can be supported in a substantially vertical direction. Therefore, a user can exchange the roll medium in a state where the roll medium feeding shaft is kept substantially stably.

(2) In the roll medium feeding shaft according to the aspect described above, the shaft may include a first shaft including the one end of the shaft, and a second shaft including the other end of the shaft and coupled to the first shaft with an elastic body, and the other end of the shaft may be arranged at a position protruded from the holding member. The shaft may be in the first state when the support part is placed on a horizontal surface, the elastic body deforms, and as a result the first shaft moves relative to the holding member, and the shaft may be in the second state when the first shaft receives no external force. With the roll medium feeding shaft according to the aspect, the elastic body causes the shaft to switch from the first state to the second state. Therefore, a user can easily switch the shaft from the first state to the second state.

(3) The roll medium feeding shaft according to the aspect described above may include, as the support part, a rotation transmission part provided to one of end parts of the holding member and configured to receive an external force applied to an outer circumference to transmit rotation to the holding member may be included. A minimum value of a width of the rotation transmission part in a direction perpendicular to the rotary axis may be equal to or above a maximum value of a width of the holding member in the direction perpendicular to the rotary axis. With the roll medium feeding shaft according to the aspect, the rotation transmission part having a width equal to or above the width of the holding member serves as the support part. Therefore, compared with an aspect where the holding member serves as the support part, the roll medium feeding shaft can be further stably supported.

(4) The roll medium feeding shaft according to the aspect described above may further include a rotation transmission part provided to the other end side of the shaft and configured to receive an external force applied an outer circumference to transmit rotation to the holding member. A maximum value of a width of the rotation transmission part in a direction perpendicular to the rotary axis may be smaller than a minimum value of a width of the holding member in the direction perpendicular to the rotary axis. With the roll medium feeding shaft according to the aspect, the rotation transmission part having a width smaller than the width of the holding member is provided to the end part opposite to the end part provided with the support part. Therefore, even when the rotation transmission part is further small-sized, the roll medium feeding shaft can be stably supported.

(5) According to another aspect of the invention, a roll medium feeding shaft to be inserted into a through hole of a roll medium formed by winding a long recording medium is provided. The roll medium feeding shaft includes a holding member configured to be inserted into the through hole and to be rotated about a rotary axis together with the roll medium, a support part provided to one end of the roll medium feeding shaft and configured to support the holding member in a vertical direction when placed on a horizontal surface, and a shaft provided inside the holding member. The support part is provided to the one end of the shaft, and is configured to receive an external force applied to an outer circumference to transmit rotation to the holding member. A minimum value of a width of the support part in a direction perpendicular to the rotary axis is equal to or above a maximum value of a width of the holding member in the direction perpendicular to the rotary axis. With the roll medium feeding shaft according to the aspect, the rotation transmission part provided to the end part of the shaft can serve as the support part. That is, a user can place the rotation transmission part on a horizontal surface, and exchange the roll medium in a state where the roll medium feeding shaft is supported in the vertical direction. Therefore, the user can exchange the roll medium without allowing the roll medium and the horizontal surface to come into contact with each other. With the roll medium feeding shaft according to the aspect, the rotation transmission part having a width equal to or above a width of the holding member serves as the support part. Therefore, compared with an aspect where the holding member serves as the support part, the roll medium feeding shaft can be further stably supported.

(6) According to still another aspect of the invention, a roll medium feeding shaft to be inserted into a through hole of a roll medium formed by winding a long recording medium is provided. The roll medium feeding shaft includes a holding member configured to be inserted into the through hole and to be rotated about a rotary axis together with the roll medium, a support part provided to one end of the roll medium feeding shaft and configured to support the holding member in a vertical direction when placed on a horizontal surface, and to serve as at least three or more support legs on end part of the holding member. When the roll medium feeding shaft is projected onto a horizontal surface in parallel to the vertical direction, the support legs are outermost of the roll medium feeding shaft. With the roll medium feeding shaft according to the aspect, the roll medium feeding shaft can be supported by the legs in the vertical direction. Therefore, the user can exchange the roll medium without allowing the roll medium and the horizontal surface to come into contact with each other.

The invention can be realized in various aspects other than a roll medium feeding shaft. For example, the invention can be achieved in aspects including a method of producing a roll medium feeding shaft, a printing apparatus, a liquid discharging apparatus, a method of producing a printing apparatus, and a method of producing a liquid discharging apparatus, for example.

This application claims priority under 35 U.S.C. § 119 to Japanese Patent Application No. 2018-054051, filed Mar. 22, 2018. The entire disclosure of Japanese Patent Application No. 2018-054051 is hereby incorporated herein by reference.

What is claimed is:

1. A roll medium feeding shaft to be inserted into a through hole of a roll medium formed by winding a long recording medium, the roll medium feeding shaft comprising:

a holding member configured to be inserted into the through hole and to be rotated about a rotary axis together with the roll medium;

a support part provided to one end of the roll medium feeding shaft and configured to support the holding member in a vertical direction when placed on a horizontal surface; and a shaft provided inside the holding member and configured to be movable inside the holding member along the rotary axis, wherein the shaft is configured to be in one of a first state where one end of the shaft does not protrude from the support part, and a second state where the one end of the shaft protrudes from the support part, and when the one end of the shaft is oriented downward in the vertical direction and the support part is placed on the horizontal surface, the shaft is in the first state.

2. The roll medium feeding shaft according to claim 1, wherein the shaft includes:

a first shaft including the one end of the shaft; and a second shaft including the other end of the shaft and coupled to the first shaft with an elastic body, the other end of the shaft being arranged at a position protruded from the holding member, the shaft is in the first state when the support part is placed on the horizontal surface, the elastic body deforms, and as a result the first shaft moves relative to the holding member, and the shaft is in the second state when the first shaft receives no external force.

3. The roll medium feeding shaft according to claim 1, comprising, as the support part, a rotation transmission part provided to one of end parts of the holding member and configured to receive an external force applied to an outer circumference to transmit rotation to the holding member, wherein a minimum width of the rotation transmission part in a direction perpendicular to the rotary axis is equal to or above a maximum width of the holding member in the direction perpendicular to the rotary axis.

4. The roll medium feeding shaft according to claim 1, further comprising a rotation transmission part provided to the other end side of the shaft and configured to receive an external force applied to an outer circumference to transmit rotation to the holding member, wherein a maximum width of the rotation transmission part in a direction perpendicular to the rotary axis is smaller than a minimum width of the holding member in the direction perpendicular to the rotary axis.

* * * * *